US005486901A

United States Patent [19]

Fukuchi et al.

[11] Patent Number: 5,486,901

[45] Date of Patent: Jan. 23, 1996

[54] COLOR IMAGE RECORDING APPARATUS WITH A DETECTOR TO DETECT A SUPERIMPOSED TONER IMAGE DENSITY AND CORRECTING ITS COLOR BALANCE

[75] Inventors: Masakazu Fukuchi; Shizuo Morita; Shizuo Kayano; Kunihisa Yoshino, all of Hachioji, Japan

[73] Assignee: Konica Corporation, Tokyo, Japan

[21] Appl. No.: 27,871

[22] Filed: Mar. 8, 1993

[30] Foreign Application Priority Data

| | | | |
|---|---|---|---|
| Mar. 10, 1992 | [JP] | Japan | 4-087667 |
| Apr. 14, 1992 | [JP] | Japan | 4-121437 |
| May 15, 1992 | [JP] | Japan | 4-148429 |

[51] Int. Cl.[6] ..... G03G 15/01

[52] U.S. Cl. ..... 355/208; 355/246; 355/327

[58] Field of Search ..... 355/208, 246, 355/326 R, 327

[56] References Cited

U.S. PATENT DOCUMENTS

| | | | |
|---|---|---|---|
| 3,754,821 | 8/1973 | Whited | 355/326 R |
| 3,799,668 | 3/1974 | McVeigh | 355/326 R |
| 3,825,337 | 7/1974 | Lucas | 355/326 R |
| 4,799,082 | 1/1989 | Suzuki | 355/326 R |
| 4,894,685 | 1/1990 | Shoji | 355/246 |
| 4,970,536 | 11/1990 | Haneda et al. | 346/157 |
| 5,103,260 | 4/1992 | Tompkins et al. | 355/208 |
| 5,298,960 | 3/1994 | Fukuchi et al. | 355/326 R |
| 5,327,209 | 7/1994 | Sasanuma et al. | 355/327 |

FOREIGN PATENT DOCUMENTS

| | | |
|---|---|---|
| 57-136669 | 8/1982 | Japan . |
| 0080865 | 5/1985 | Japan . |
| 0106672 | 5/1988 | Japan . |
| 0281470 | 11/1989 | Japan . |

*Primary Examiner*—Robert Beatty

*Attorney, Agent, or Firm*—Frishauf, Holtz, Goodman, Langer & Chick

[57] ABSTRACT

A method for forming a toner image on a photoreceptor includes charging a photoreceptor to a charged electric potential; exposing the photoreceptor so as to form a reference latent image for each of three colors with an exposure light having a reference image density; developing the three reference latent images with yellow, magenta and cyan developers each of the developers including a carrier and one of the yellow, magenta and cyan color developer so as to form a superimposed three color toner image; detecting a color balance between the superimposed three color toner images by separating reflected light from the superimposed images; and consuming at least one color developer of the yellow, magenta and cyan developers in accordance with a detection result of the color balance so that a new color balance of the superimposed three color toner images will have a desired color balance.

20 Claims, 20 Drawing Sheets

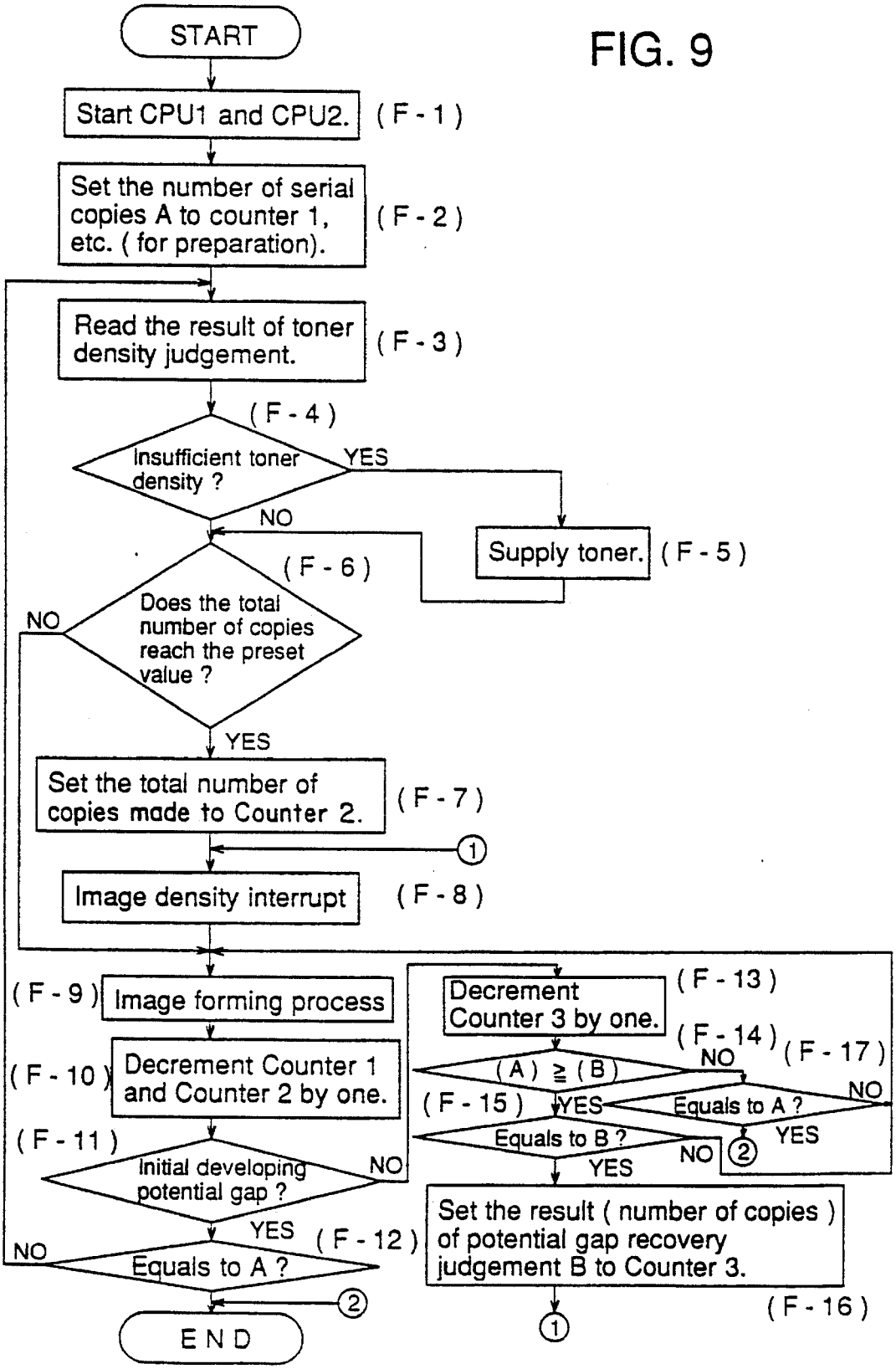
FIG. 9
START
Start CPU1 and CPU2.
( F - 1 )
Set the number of serial copies A to counter 1, etc. ( for preparation).
( F - 2 )
Read the result of toner density judgement.
( F - 3 )
( F - 4 )
Insufficient toner density ?
YES
NO
Supply toner.
( F - 5 )
( F - 6 )
Does the total number of copies reach the preset value ?
NO
YES
Set the total number of copies made to Counter 2.
( F - 7 )
1
Image density interrupt
( F - 8 )
( F - 9 )
Image forming process
( F - 10 )
Decrement Counter 1 and Counter 2 by one.
( F - 11 )
Initial developing potential gap ?
NO
YES
( F - 12 )
NO
Equals to A ?
2
END
Decrement Counter 3 by one.
( F - 13 )
( F - 14 )
( A ) ≧ ( B )
NO
( F - 17 )
( F - 15 )
YES
Equals to A ?
NO
YES
Equals to B ?
NO
2
YES
Set the result ( number of copies ) of potential gap recovery judgement B to Counter 3.
( F - 16 )
1

FIG. 15

| | | | Gray scale 3 | | | Gray scale 6 | | |
|---|---|---|---|---|---|---|---|---|
| Case | Gray status ( observed ) | Toner requirement | IR | IG | IB | IR | IG | IB |
| C1 | 2 to 3 : Reddish | C ( Little ) | 11 | 10 | 10 | 11 | 11 | 11 |
| C2 | 2 to 6 : Reddish | C ( Large ) | 11 | 00 | 00 | 11 | 01 | 01 |
| C3 | 2 to 3 : Bluish | Y ( Little ) | 10 | 10 | 11 | 11 | 11 | 11 |
| C4 | 2 to 6 : Bluish | Y ( Large ) | 00 | 00 | 11 | 01 | 01 | 11 |
| C5 | 2 to 3 : Greenish | M ( Little ) | 00 | 11 | 00 | 11 | 11 | 11 |
| C6 | 2 to 6 : Greenish | M ( Large ) | 10 | 11 | 10 | 01 | 11 | 01 |
| C7 | 2 to 3 : Yellowish | M,C ( Little ) | 11 | 11 | 10 | 11 | 11 | 11 |
| C8 | 2 to 6 : Yellowish | M,C ( Large ) | 11 | 11 | 00 | 11 | 11 | 01 |
| C9 | 2 to 3 : Rather magenta | Y,C ( Little ) | 11 | 10 | 11 | 11 | 11 | 11 |
| C10 | 2 to 6 : Rather magenta | Y,C ( Large ) | 11 | 00 | 11 | 11 | 01 | 11 |
| C11 | 2 to 3 : Rather cyan | Y,M ( Little ) | 10 | 11 | 11 | 11 | 11 | 11 |
| C12 | 2 to 6 : Rather cyan | Y,M ( Large ) | 00 | 11 | 11 | 01 | 11 | 11 |
| C13 | 2 to 6 : Grayish | None ( Normal ) | 11 | 11 | 11 | 11 | 11 | 11 |

COLOR IMAGE RECORDING APPARATUS WITH A DETECTOR TO DETECT A SUPERIMPOSED TONER IMAGE DENSITY AND CORRECTING ITS COLOR BALANCE

BACKGROUND OF THE INVENTION

This invention relates to an image recording device employing a method of developing invisible electrostatic latent images into visible images by two-component developing agent comprising toner and carriers, in which developing conditions are controlled to obtain optimum image density.

In a developing device which develops the electrostatic latent image on a carrier using a two-component developing agent comprising toner and a carrier, development is greatly dependent upon the ratio of weights of toner and carrier (termed toner concentration Tc) in the two-component developing agent. For instance, in case the toner concentration of the developing agent is less than the optimum concentration, the developed image would become whiter. Contrarily, in case the toner concentration is greater than the optimum concentration, the developed image would become darker and fogged. Therefore, the image on the transfer material which is transferred from the carrier would not be desirable.

To always obtain desirable image densities, it is required to control the concentration of toner in the 2-component developing agent so it may remain in a preset right level during development. Conventionally, a density control method has been proposed to keep the concentration of toner in the 2-component developing agent at a preset level by controlling the amount of supply of toner. This control method controls to keep the concentration of toner in the 2-component developing agent at a preset level by detecting changes of events such as permeability or volumetric change of the 2-component developing agent, change in image density of the developed image, change in color of the 2-component developing agent comprising toner and carrier whose colors are different and by controlling the amount of supply of toner according to the detected toner concentration.

However, this conventional method cannot be stable for a long period because it cannot escape from false detections, deterioration of photosensitive surfaces with the lapse of time, etc.

One of solutions to such problems is introduced in "2-Component Developer Concentration Control Equipment" (Patent Publication No.57-136669). To keep the optimum developing effect of the recording device stable for a long period, this 2-component developer concentration control equipment is equipped with two or more liquid level sensors in the developer to detect the volume of the 2-component developing agent in the developer and means to optically detect the toner concentration of a developed or recorded reference image on the sensitive surface. The central processing unit changes the liquid levels according to the optically detected image density and thus controls the concentration of toner in the 2-component developing agent to obtain constant developing performance with less carrier supply. With this, the above purpose has been attained temporarily.

Generally, documents to be image-recorded have different photographic densities therein. For documents having low photographic densities such as substantially white documents including lines or character patterns are image-recorded and developed continuously, it sometimes happened that the resulting image density was less than the image density corresponding to the toner concentration although the toner concentration was constant. In other words, the relationship between the toner concentration and the image density is broken. We have known that such events are often found in color electrostatic recording devices that reproduces color images by using 2-component developing agent for each color.

After researching into the cause of such events thoroughly, we have reached the following conclusions: As the result of analysis of events found in both of the above examples, we found that this event is closely dependent upon the time of agitation during which the developing sleeve and the agitating means in the developer rotate continuously during the image forming process, that is, the time in which the 2-component developing agent stays in the toner hopper. In the former example of image-recording of substantially white documents, the quantity of toner consumed per unit time is less than that of toner consumed in the normal status and consequently toner stays longer in the toner hopper. In the latter example of color-image recording, the 2-component developing agent for each color consumes a different quantity of toner and consequently, times in which toners for colors stay in the toner hoppers are different.

Judging from the fact that said events will occur even when the toner concentration is constant, we can assume that the said events are not due to the Spent Toner status in which toner components attach around carriers and the quantity of toner charge is reduced. Contrarily as the events are dependent upon the time period in which toner stays in the toner hopper, we can assume that the toner can have more chance to be in contact with the carrier as the toner stays longer in the toner hopper, that the quantity of toner charge increases, and that the excessive toner charge will affect the image concentration. Then, we have researched the relationship between the quantity of toner charge and the image density.

FIG. 4 illustrates how the image density CD changes as the quantity of toner charge Q/m (μC/g) changes in case the toner concentration of a 2-component developing agent is constant.

In FIG. 4, we know that the image density CD goes down as the quantity of toner charge Q/m increases. To be more concrete, when the quantity of toner charge Q/m is 10 (μC/g), the image density is approximately 1.4 and when the quantity of toner charge Q/m is 30 (μC/g), the image density is approximately 0.5.

Such a relationship between the image density CD and the quantity of toner charge Q/m can be explained from the view point of a force (hereinafter called a developing force) that the toner in the 2-component developing agent which is magnetically held by the developing sleeve receives in the developing area in which an electrostatic latent image is developed.

Let the developing force be designated as Ft, the developing force Ft is approximately expressed as shown below.

$$F_t = q_t \cdot E - k(q_t \cdot q_c / r^2) - q_t(V_B/R)$$

(where qt is the quantity of toner charge. E is the electric field strength made by an electrostatic latent image (hereinafter called a latent electric field). qc is the quantity of carrier charge. r is the distance between toner and carrier. VB is a voltage (hereinafter called a developing bias) applied to the developing sleeve. R is the distance between the surface of the photosensitive drum and the surface of the developing sleeve.)

In Equation 1, the developing force Ft is obtained by subtracting the force of attraction between toner and carrier (hereinafter called a Coulomb force) and a developing bias force acting on the toner from a force caused by the latent electric field E. Note that the force determining the developing force Ft is proportional to the quantity of toner charge qt (Q/m) but the Coulomb force that reduces the developing force Ft is apt to increase greater than the other forces as the quantity of carrier charge qc also increases as the quantity of toner charge qt (Q/m) increases. Therefore, the increase of the quantity of toner charge qt (Q/m) causes the developing force Ft to reduce and the reduction of the quantity of toner charge qt (Q/m) causes the developing force Ft to increase.

FIG. 5 illustrates how the image density CD changes according to the concentration (wt %: weight percentage) of toner in the 2-component developing agent stored in the developer.

In this figure, the 2-component developing agent comprises insulating magnetic carrier whose mean grain diameter is 20 μm to 100 μm (resin-coated; magnetic grains dispersed in resin) and toner whose mean grain diameter is 5 μm to 15 μm.

In FIG. 5, the solid line A indicates a CD-Tc characteristic curve in case the developing bias VB is 200 volts. In this case, the image density CD is about 0.4 for toner concentration of about 1 wt %, about 1.0 for toner concentration of about 5 wt %, and fixed to about 1.2 for toner concentration of 5 wt % or more. On the characteristic curve A, the image density CD is in the range of about 0.4 to about 1.2 with a wider contrast range. In this status, toner is well attached to the surface of the photosensitive drum which is the carrier of a latent image and unwanted image deviation will rarely be found. Therefore it is recommended to control the image density along the characteristic curve A.

The dash-dot line B shows the relationship between the toner concentration Tc (wt %) and the image density CD in case the time of agitating the 2-component developing agent becomes longer and the quantity of toner charge qt (Q/m) becomes much greater than that of solid line A. The other conditions such as the developing bias VB for the dash-dot line B are the same as those of the solid line A. In this case, as shown in Equation 1, as the Coulomb force increases greater than the other electrostatic forces, the force that attracts toner to the surface of the photosensitive drum reduces in inverse proportion to the Coulomb force and the image density goes down. To be more concrete, the dash-dot line B becomes fixed to about image density of 0.5 starting from toner concentration of 5 wt %. Therefore, we cannot obtain enough image density CD (in comparison with the original images) on the curve B and consequentially, the resulting contrast is not satisfactory, either.

The dotted line B represents the Tc-CD characteristic curve in case the quantity of toner charge falls under that of the solid line A because of an environmental change (e.g., increase of relative humidity). In this case, the force of attraction (Coulomb force) between toner and carrier is not enough and the image density CD becomes greater than that of the solid line A. To be more concrete, the image density CD reaches about 0.7 for toner concentration of 1 wt %, then fixed to about 1.4 for higher toner concentration. Accordingly, images developed along the dotted line C can have an enough contrast width. However, excessive toner attaches to the latent image and the developed image is far from the original one. What is worse, an image deviation is apt to occur.

This invention has been made to solve the above problems. The first purpose of this invention is to offer an image recording device that reproduces images of optimum image density by detecting any change (decrease or increase) of the image density while the toner concentration is kept constant and regulating the developing conditions.

FIG. 11*a* shows how the toner for each color is consumed according to the number of copies in a color image recording device that records color images by 2-component developing agents of several colors. FIG. 11*b* shows how the quantity of toner charge for each color changes according to the number of copies in a color image recording device. FIG. 11*c* shows how the optical image density CD changes according to the number of copies in a color image recording device.

The optical image density is the magnitude of light reflected from a standard toner image which the optical scanning system formed on the photosensitive drum according to an image signal corresponding to the light reflected by a standard density plate and which was developed under a preset electrostatic processing condition.

FIG. 11*a* is for an example of copying a certain colored document. The solid line BK represents how much the black toner is consumed as the number of copies increases. The standard consumption of black toner is about 80 mg each JIS-A4 size paper and about 240 g for 3000 sheets of JIS-A4 size paper.

The solid line Y represents how much the yellow toner is consumed as the number of copies increases. The standard consumption of yellow toner is about 50 mg each JIS-A4 size paper and about 150 g for 3000 sheets of JIS-A4 size paper. The solid line C represents how much the cyan toner is consumed as the number of copies increases. The standard consumption of cyan toner is about 50 mg each JIS-A4 size paper and about 150 g for 3000 sheets of JIS-A4 size paper. The solid line M represents how much the magenta toner is consumed as the number of copies increases. The standard consumption of magenta toner is about 10 mg each JIS-A4 size paper and about 30 g for 3000 sheets of JIS-A4 size paper. Namely, the amounts of toners in the developing agent to be consumed are different.

These characteristic lines assume that the developing characteristics of each color remain unchanged after 3000 copies.

For simplification of control, the developing sleeve and the agitating means in the developer of the conventional image recording device rotate continuously during the time of development in the image forming process. Therefore, the quantity of toner charge of each color in the developer varies since the toners stay longer in the developer. Some examples are explained below.

In FIG. 11*b*, the solid line BK represents how the quantity of charge of black toner (Q/m) changes as the number of copies increases. Namely, this line shows that the quantity of charge of black toner is approximately constant regardless of the number of copies. This is, we assume, because the toner concentration controller controls the supply of toner as it is consumed and consequentially there is little toner that stays long in the developer.

The solid line Y in FIG. 11*b* represents how the quantity of charge of yellow toner (Q/m) changes as the number of copies increases. The solid line C represents how the quantity of charge of cyan toner (Q/m) changes as the number of copies increases. The solid lines Y and C go up very slowly as the number of copies increases. We assume that this is because some excessive toner remains longer although the toner concentration controller controls the supply of toner as it is consumed.

The solid line M represents how the quantity of charge of magenta toner (Q/m) changes as the number of copies increases. The quantity of toner charge goes up quickly as the number of copies increases. We assume that this is because a lot of excessive toner remains longer although the toner concentration controller controls the supply of toner as it is consumed. As mentioned above, when a new developing agent for each color is loaded, the BK, C, Y, and M toners have approximately the same quantities of charges and have little influence on the developing characteristics. However, as copying advances, the developing agents are consumed differently and some kinds of toners will stay long in the developer, which causes a change in quantities of toner charges and a change in developing characteristics.

This difference in the quantities of toner charges in color developing agents causes the following events:

In FIG. 11*c*, the solid line BK shows how the optical image density CD of black toner changes as the number of copies increases. Namely, the optical image density (developing characteristics) of black toner is approximately constant independently of the number of copies. The solid line Y shows how the optical image density CD of yellow toner changes as the number of copies increases. The solid line C shows how the optical image density CD of cyan toner changes as the number of copies increases. These lines increase slowly as copying advances. Namely, the developing characteristics of yellow and cyan toners reduce as copying advances. The solid line M shows how the optical image density CD of magenta toner changes as the number of copies increases. The optical image density goes low extremely as copying advances. Namely, the developing characteristics of magenta toner reduces quickly.

As mentioned above, in an image recording device that continuously agitates developing agent in each color developer during the whole developing time, color developing agents are consumed differently and consequently the time periods during which color toners are agitated differ. This damages the developing characteristics, causing reduction in image density in monochromatic image reproduction, color unbalance in color image reproduction, etc.

This invention is made to solve the above-mentioned problems. The secondary purpose of the present invention is to offer a color image forming device that detects any change (decrease or increase) in the image density of color developing agents although the concentration of color toners are controlled at preset levels, regulates the electrostatic process conditions, and reproduces well-balanced color images of optimum image densities.

SUMMARY OF THE INVENTION

To attain the above primary purpose, the image recording device in accordance with the present invention comprising 2-component developing means that develop electrostatic images formed on the carrier with 2-component developing agents comprising carrier and toner by applying a developing bias, toner concentration detecting means that detects the concentrations of toners of the said 2-component developing agents, and toner supply controlling means that controls the supply of toners according to the toner concentrations detected by the said toner concentration detecting means is equipped with a reflection-type density detecting means that detects the image density reflected from a reference toner image formed on the said image carrier and developing bias controlling means that changes the developing bias when the reflected image density of the reference toner image detected by the said reflection-type detecting means is lower or higher than a preset level although the toner concentration detected by the said toner concentration detecting means is substantially constant and returns the developing bias to the preset level when the reflection image density of the said reference toner image returns to the preset level.

The 2-component developing means develops electrostatic images formed on the carrier with 2-component developing agents comprising carrier and toner by applying a developing bias. The toner concentration detecting means detects concentrations of toners in 2-component developing agents. The toner supply controlling means controls the supplies of toners according to the concentrations of toners detected by the toner concentration detecting means. The reflection-type density detecting means detects the image density reflected from the reference toner image formed on the image carrier.

The developing bias controlling means changes the developing bias when the reflected image density of the reference toner image detected by the said reflection-type detecting means is lower or higher than a preset level although the toner concentration detected by the said toner concentration detecting means is substantially constant and returns the developing bias to the preset level when the reflection image density of the said reference toner image returns to the preset level.

To attain the secondary purpose, the color image recording device that forms a multi-color toner image on a photosensitive material in accordance with the present invention comprising charging means that gives uniform charge on the photosensitive material, image exposing means that emits optical signals containing color image information to the said photosensitive material to form an electrostatic latent image on it, plural 2-component developing means each of which is provided for a predetermined color and develops an electrostatic image formed on the photosensitive material by the said image exposing means with 2-component developing agents comprising toner and carrier for each color, is equipped with toner concentration detecting means that detects the concentration of each color toner in the 2-component developing agents respectively, means to detect the amount of each color toner attached to a multi-color reference toner image formed on the said photosensitive material, and means to control the quantity of each color toner by controlling the said charging means and the said developing bias means when the quantity of a color toner of the multi-color reference toner image detected by the said toner quantity detecting means although the concentration of the color toner detected by the toner concentration detecting means is constant substantially and by increasing the developing potential gap for the development by the 2-component developing agents according to the degree of reduction of the quantity of the attached toner.

The charging means gives an even charge to the photosensitive material. The image exposing means emits optical signals containing color image information to the said photosensitive material to form an electrostatic latent image on it. The plural 2-component developing means each of which is provided for a predetermined color respectively contain developing bias means and develops an electrostatic image formed on the photosensitive material by the said image exposing means with 2-component developing agents comprising toner and carrier for each color to form a multi-color toner image.

The toner concentration detecting means detects the concentration of the toner in each color 2-component developing agent. The toner supply control means controls the supply of each color toner according to the toner concentration detected by the toner concentration detecting means.

The toner quantity detecting means detects the quantity of each color toner of a multi-color reference toner image formed on the photo-sensitive material.

The toner quantity control means detects a color toner whose quantity in the multi-color reference toner image falls under a predetermined quantity although the concentration of the color toner detected by the toner quantity detecting means is substantially constant (that is, a color whose developing characteristics reduces) and controls the charging means and the developing bias means to increase the developing potential gap for development by the 2-component developing means according to the degree of the reduction of the deposited toner for recovery of optimum developing characteristics.

According to another embodiment of attaining the said secondary purpose, the color image recording method in accordance with this invention comprises a process to charge the latent image carrier uniformly, a process to expose an image on the said latent image carrier, and a process to develop using one of several developers each of which contains a predetermined color toner; where the said charging, exposing, and developing processes are repeated to form a multi-color toner image on the said latent image carrier. The said method also contains a color balance adjusting process comprising a process to expose an image according to a stepwise or continuously changing reference image density signal of the reflected image while the toner concentration is kept approximately at the predetermined level to form a reference-image exposed part, a process to develop the said exposed part using one of the developers each of which contains a predetermined color toner (yellow, magenta, or cyan toner), a process to produce a reference toner image comprising three color toner layers (yellow toner, magenta toner, and cyan toner) by repeating the said reference-image exposing process and the developing process, a process to detect a color balance of the said three-color reference toner image, and a process to consume a toner of at least one of the developers according to the result of detection in the said color balance detecting process.

Basically, this invention repeats a process to charge a latent image carrier uniformly, a process to expose an image on the said latent image carrier, and a process to develop the latent image using one of several developers each of which contains a predetermined color toner and thus forms a multi-color toner image on the said latent image carrier. Furthermore, this invention contains the following processes:

A reference image exposing process which exposes an image according to a reference image density signal when the reflection density changes stepwise or gradually as a preset number of copies are made although the concentrations of toners are kept approximately constant and thus forms a reference image exposure part on the latent image carrier. A process which develops the reference image exposure part with one of developers each of which contains a predetermined color toner (yellow, magenta, or cyan toner). A reference toner image forming process which repeats the imaging process and the developing process to form a 3-color reference toner image (including yellow, magenta, and cyan toner layers). A color balance detecting process which detects the balance of colors of the 3-color reference toner image and A toner consuming process which consumes color toner(s) in at least one of the developers to recover the normal color balance status if the colors of the 3-color reference toner image are not balanced in the color balance detecting process. These processes are carried out sequentially.

BRIEF DESCRIPTION OF THE DRAWINGS

FIG. 9 is a flow chart of the image recording operation of an image recording device in accordance with the present invention.

FIG. 15 shows the relationship between densities of colors constituting a reference toner image and their color balance states.

DETAILED DESCRIPTION OF THE PREFERRED EMBODIMENT

The preferred embodiment of the present invention will be explained in detail with reference to the attached figures.

Figure 1:
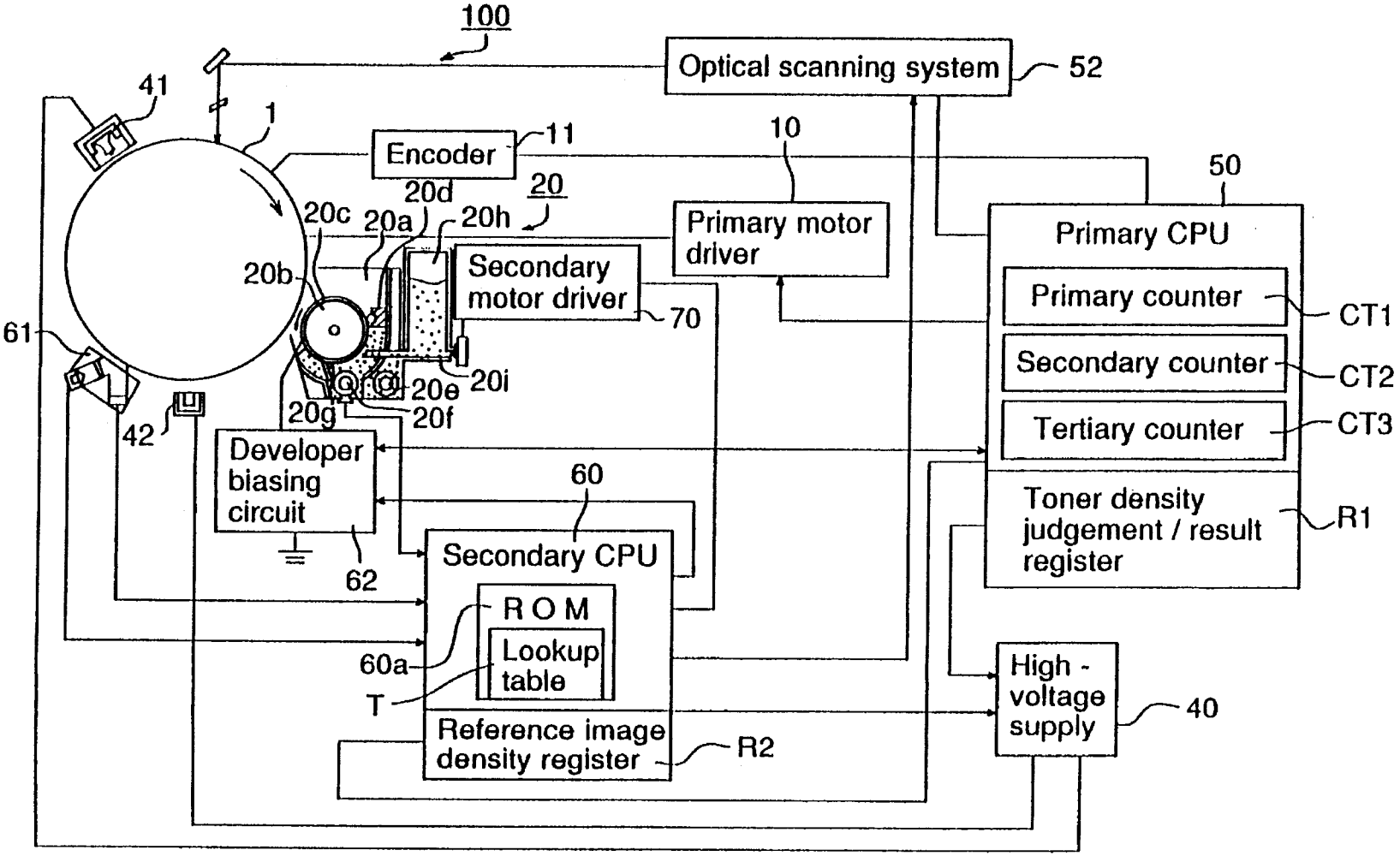
FIG. 1 is a block diagram of an image recording device illustrating one embodiment of the present invention.

FIG. 1 is a block diagram of an image recording device illustrating one embodiment of the present invention.

The image recording device 100 is equipped with a photo sensitive drum 1 working as a latent image carrier, a primary motor driver 10 controlling the rotation of the photosensitive drum 1, a developer 20, a high-voltage power supply 40, a transfer 42, a charger 41, an optical scanning system 52, a primary CPU 50, a secondary CPU 60, an optical concentration measuring means 61, a developing bias circuit 62, and a toner concentration detecting means 63BK, 63C, 63, 63M and 63Y. When a COPY button (not shown in this figure) is pressed, the primary CPU 50 causes the light source to emit light onto the photosensitive drum 1 according to an image signal representing the image density of the original document sent from the optical scanning system 52 to form an electrostatic latent image on the photosensitive surface of the photosensitive drum 1. This latent image is rendered visible as a toner image by the developer 20. The toner image is transferred to paper by the transfer device 42 which is driven to discharge according to a resist signal. The toner image transferred to the paper is then fixed for permanent preservation.

The photosensitive drum 1 is an aluminum conductive drum of 80 mm in diameter and having an intermediate layer of 0.1 μm thick made of copolymer of ethylene and vinyl acetate and a photo sensitive layer of 35 μm thick on the drum (also termed an OPC photosensitive unit). When a light beam is applied to the said photosensitive layer, the surface potential of the illuminated area reduces. Therefore, when light beams representing gray scales of an original image are applied to the photosensitive drum which has been evenly charged to have a preset potential, the photosensitive drum has uneven charges, that is, reduced potentials on it whose pattern is similar to the gray-scale pattern of the original image. This is a so-called electrostatic latent image. The photosensitive drum 1 is not limited to the above. For instance, it can be made of amorphous silicon. For convenience, the descriptions below are made using the above OPC photosensitive unit.

The primary motor driver 10 is a circuit to drive and control a main motor (not shown in the figure) that revolves the photosensitive drum 1. This circuit controls the rotation and speed (rpm) of the main motor according to a control signal sent from the primary CPU 50.

The encoder 11 generates pulse signals of a preset width in proportion to the rotational phases of the photosensitive drum 1 and outputs them to the primary CPU 50. With these pulse signals, the primary CPU 50 detects the rotational phases of the photosensitive drum 1.

The optical scanning system 52, if it is of the analog type, can be a scanning system of the prior art. For example, the analog type optical scanning system consists of a lamp combined with the primary scanning mirror and a secondary scanning mirror (called a V mirror) which moves just half as fast as the primary scanning mirror. This optical scanning system scans documents with the length of light path before the lens kept constant. A reference density plate (e.g., equivalent to the optical reflection density of 1.0) is provided on the lower end of the glass plate on which an original document is placed. This reference density plate is illuminated by the lamp so that a reference density image may be formed on the photosensitive drum 1. The reference density image is then developed with toner.

There are two types of digital optical scanning system: a system using a method of reading light beams reflected by a reference density plate, outputting a corresponding image signal, and forming a reference latent image and a system using a method of storing image data of the reference density part in memory and forming a reference image according to this data. The optical scanning system 52 of the digital type as the image exposing means to form an electrostatic latent image can be a laser scanning system equipped with a polygon mirror and the like to rotatively scan laser beams emitted by a semiconductor laser which is modulated by an image signal or a fixed scanning system comprising an LED array and a liquid crystal unit. For convenience, the descriptions below are made using the analog type optical scanning system.

Figure 7:
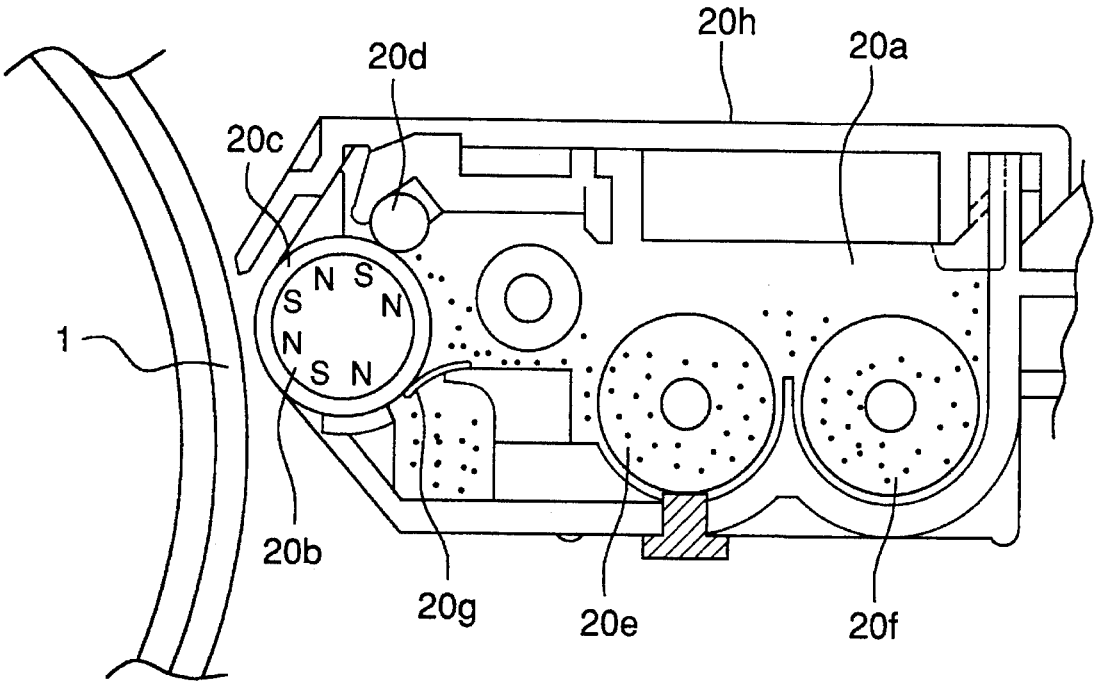
FIG. 7 is a sectional side view of a developer of a color image recording device illustrating one embodiment of the present invention.

As shown in FIGS. 1 and 7, the developer 20 comprises a sleeve 20*c* including a magnet roller 20*b* having a plurality of N and S poles in a developing container which is made with a lower casing and an upper casing, a rigid limiting material 20*d* provided in the lower casing in close contact with the said sleeve 20*c*, screw-shaped primary and secondary agitating rollers 20*e* and 20*f*, and a scraper 20*g* which scrapes off the 2-component developing agent from the sleeve 20*c*. The 2-component developing agent comprises toner and carrier components. The toner sticking to the carrier is carried to the sleeve 20*c* and is further carried to the developing area opposite to the photosensitive drum 1 by the sleeve 20*c*. The developer 20 also includes a toner supply screw 20*i* which is driven by a toner supply signal to supply new toner into the toner hopper through a pipe built in the toner supply screw unit. The limiting material 20*d* can be a thin-film forming means comprising a magnetic rod or plate.

The primary agitating roller 20*e* is so formed to feed the 2-component developing agent toward the front side of the sleeve 20*c* and the secondary agitating roller 20*f* is so formed to feed the 2-component developing agent toward the rear side of the sleeve 20*c*. A bulkhead is provided between the primary and secondary agitating rollers 20*e* and 20*f* so that the 2-component developing agent may circulate smoothly without stagnating locally for a long time arrangement. This can always supply fresh 2-component developing agent to the developing area, keeping the developing conditions stable.

The scraper 20*g* is pivotally supported by a roller so that it may be pressed against the sleeve 20*c* or separated from the sleeve 20*c*. While pressed against the sleeve, the scraper 20*g* scrapes off the 2-component developing agent having less toner passing through the developing area from the sleeve 20*c*.

The sleeve 20*c* is equipped with a developing bias circuit 62 that applies a voltage containing a.c. and d.c. bias components via a protective resistor to prevent fogging of the image. The developing bias circuit 62 electrostatically moves the toner in the 2-component developing agent which is carried to the developing area by the sleeve 20*c* by the electric field made by the electrostatic latent image formed on the surface of the photosensitive drum 1.

The developing bias circuit 62 consists of an a.c. power supply which supplies an a.c. bias to oscillate toner between the sleeve 20*c* and the photosensitive drum 1 in the developing area and a high-voltage power supply which applies a d.c. bias. The developing bias circuit 62 can change the developing bias according to a control signal sent from the secondary CPU 60. However, the developing bias is initially set so that it has a d.c. component (Vdc) of −250 V, the peak-to-peak voltage (Vp-p) of an a.c. component of 1500 V and an a.c. frequency (fAC) of 3 KHz if the toner concentration is 5 wt %. With these means, the developing bias circuit 62 generates an oscillating electric field between the sleeve 20*c* and the photosensitive drum 1 to cause toner particles to oscillate between the sleeve 20*c* and the photosensitive drum 1. Thus a clear toner image can be formed efficiently on the surface of the photosensitive drum 1 without making the 2-component developing agent contact with the surface of the photosensitive drum 1.

The high voltage power supply circuit 40 is a circuit to apply a predetermined high voltage to the charger 41 and transfer device 42.

The optical density measuring means 61 is equipped with a light emitting diode LED as a light source and a photodiode which receives a light reflected from a reference toner image formed on the photosensitive drum 1.

The toner concentration detecting means is a means to detect a change in magnetic permeability of the 2-component developing agent. It can be a means to detect the concentration of toner in the 2-component developing agent stored in the developer 20 or means to detect the volumetric level of the 2-component developing agent stored in the developer 20. This invention is not limited to the specific embodiments described above. However, for convenience, the description below uses the toner concentration detecting means which detects the concentration of toner by a change in magnetic permeability.

The primary CPU 50 which sequentially controls the image forming processes contains an Image Formation program to execute the image forming processes. When the COPY button is pressed, a START signal generates and starts the Image Formation program to execute the image forming processes.

The secondary CPU 60 stores lookup tables that one-to-one relate image densities CD (on characteristic curves A, B, and C) to toner concentrations Tc and an Image Density Control program consisting of a Tone Concentration Judgement subprogram and a Developing Bias Control program in the built-in ROM 60*a*. The Toner Concentration Judgement program judges whether or not the toner concentration detected by the toner concentration detecting means 63BK, 63C, 63M and 63Y falls under a predetermined value and sends an Improper Toner Concentration signal (NG signal) when the concentration of the toner is below the preset level or a Proper Toner Concentration signal (OK signal) when the concentration of the toner is right to the primary CPU 50. The primary CPU 50 contains a Toner Concentration Judgement Result register R1 which sets an NG or OK signal sent from the secondary CPU 60. When an NG signal is set in the register R1, the primary CPU 50 causes the toner to be supplied from the toner hopper 20*h* to the developer 20*a* to keep the toner concentration constant. The Developing Bias Control program detects an increase or decrease of the image density (relative to the predetermined level) (although the toner concentration is kept in the predetermined level) in a detection signal sent from the optical density detecting means 61 and controls the developing bias to keep the image density in a predetermined level. The decrease or increase of the image density is judged by detecting the image density of the light reflected from a reference density toner image on the photosensitive drum 1 and comparing it by the reference image density CD of about 1.0 (equivalent to toner concentration Tc of 5 wt %) read from the lookup table T. In this case, the reference image density is set in the Reference Image Density register R2.

The primary CPU 50 contains three counters CT1, CT2, and CT3 to count the numbers of copies in it. The primary counter CT1 counts the number of copies which are made continuously according to detection signals sent from sensors (e.g., paper ejection sensor). The secondary counter counts the number of copies indicating timing of execution of the Developing Bias Control program, that is the serial number of copies after the last developing bias control was made. To make more concrete, the Developing Bias Control program is executed each time one thousand copies are made. The tertiary counter CT3 counts the number of copies indicating timing of judging whether or not the image density returns to the predetermined level by the execution of the Developing Bias Control program, that is timing for judgement of bias recovery. To make more concrete, the primary CPU checks whether the image density returns to the predetermined level when fifty copies are made after the Developing Bias Control program was executed and returns the developing bias to the initial value according to the judgement. The counters CT1, CT2, and CT3 are decremental counters and have their initial values (number of continuous copies, serial number of copies, and number of copies for bias return judgement). When the count of each counter reaches "0", it is assumed that a predetermined number of copies are made.

Figure 2:
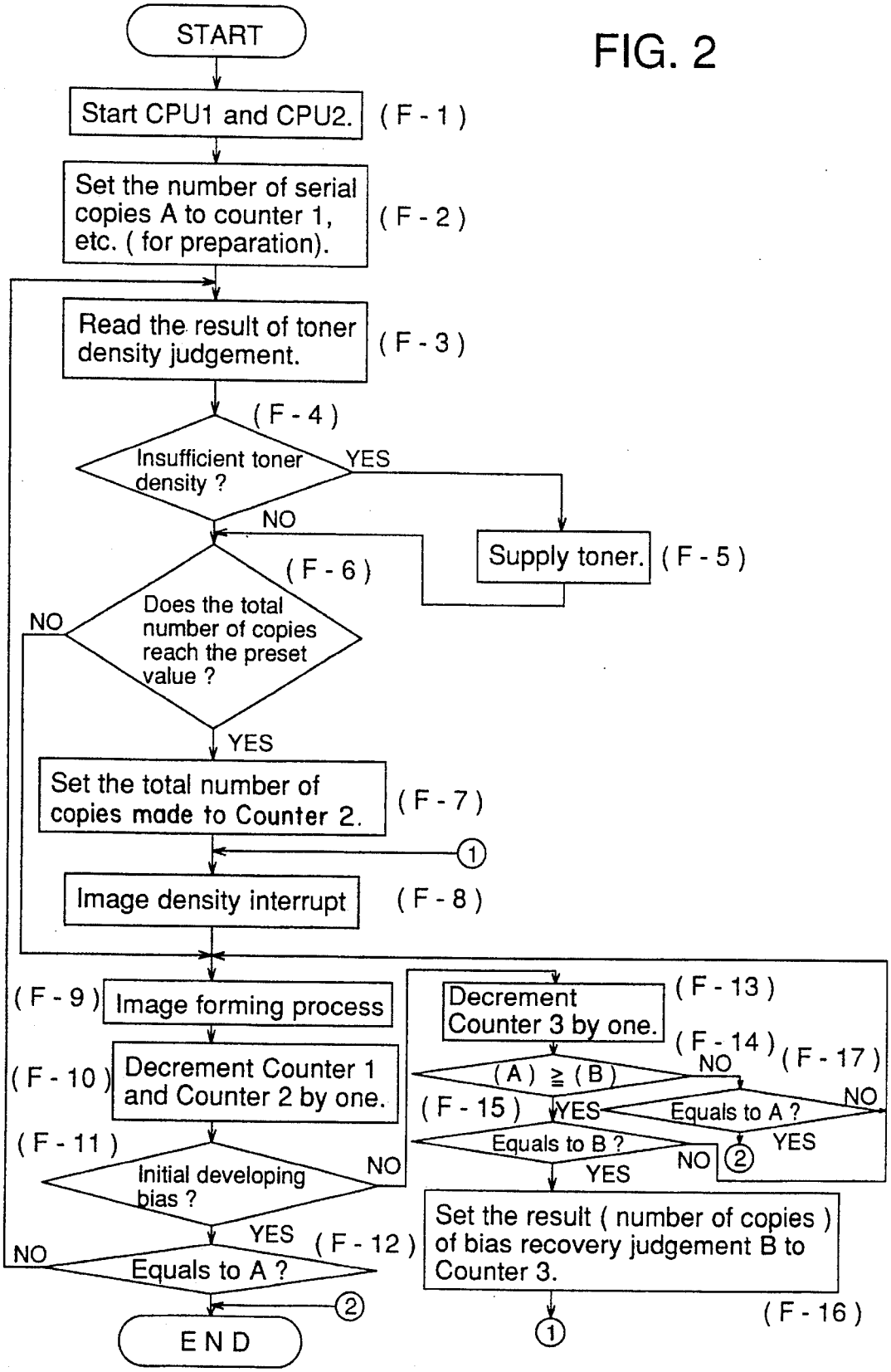
FIG. 2 is a flow chart of the image recording operation of an image recording device according to this embodiment.
Figure 3:
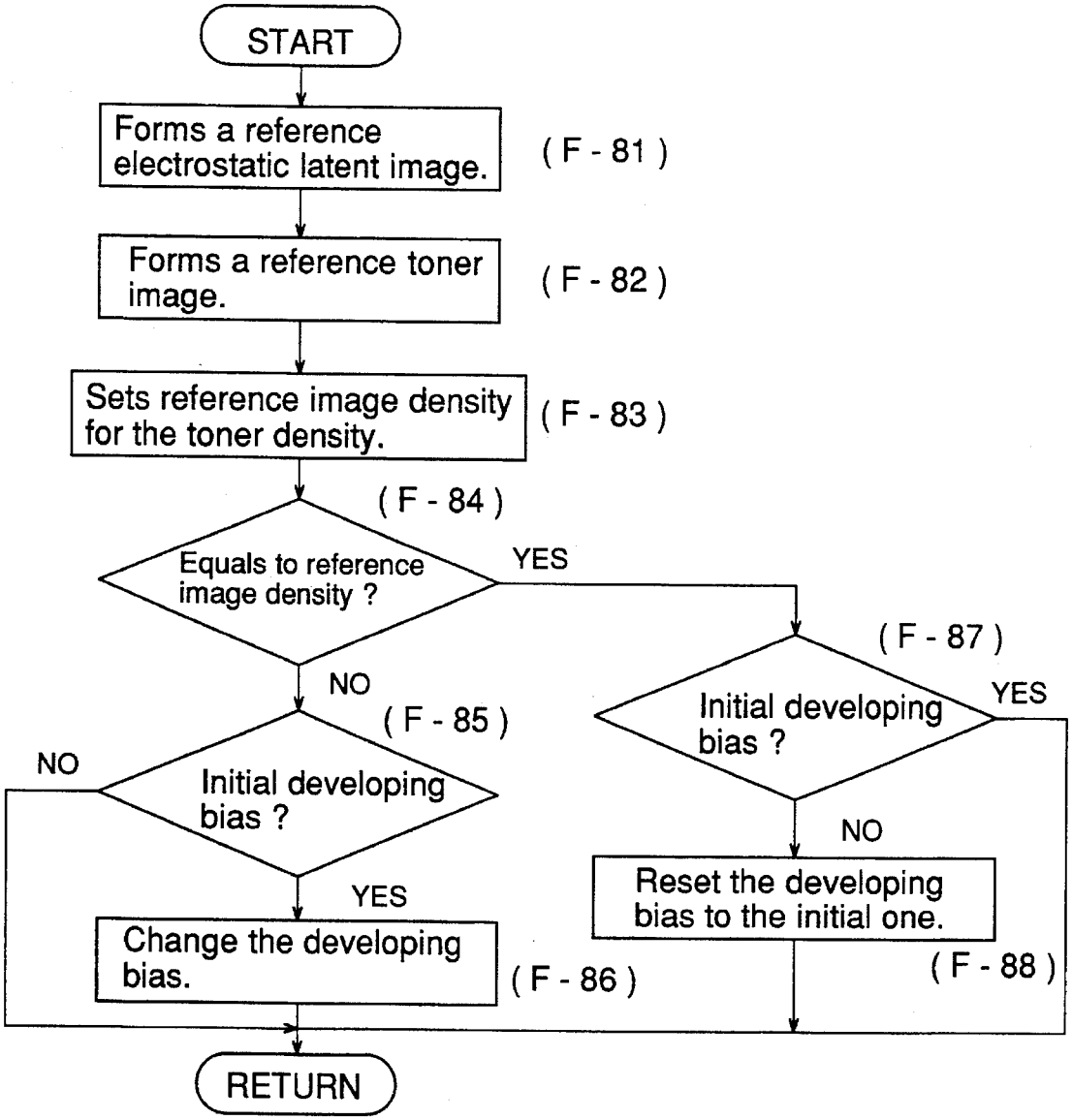
FIG. 3 is a flow chart of the image concentration controlling operation of an image recording device according to this embodiment.
Figure 4:
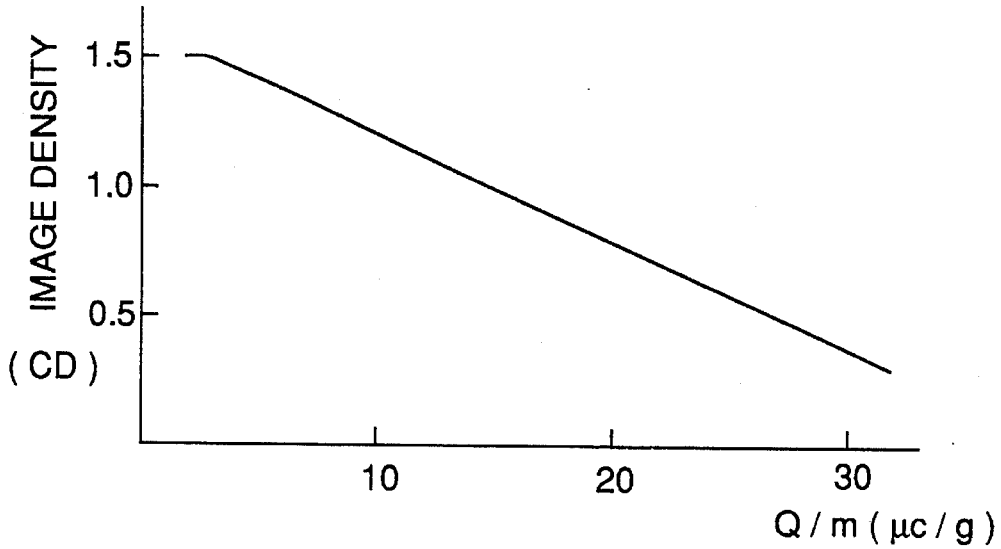
FIG. 4 shows how the image density CD changes as the concentration of toner in a 2-component developing agent (in wt %; weight percentage) stored in the developer.

The image recording operation of the image recording device of the present invention is explained below with reference to FIG. 2 and FIG. 3. FIG. 2 shows the main flow of the image recording operation executed by the primary CPU 50 and FIG. 3 is a flow of the developing bias control operation executed by the primary CPU 50.

When the main switch (not shown in the figures) is pressed, the image recording device is powered on and both primary and secondary CPUs start to run. (See Step F-1 in FIG. 2.)

The primary CPU 50 actuates the primary motor driver 10 to start the main motor. The main motor rotates the primary and secondary agitating rollers 20*e* and 20*f* in the developer 20. The 2-component developing agent is agitated by these rollers. At the same time, the heater of the fixer is heated to a predetermined temperature. The primary CPU 50 engages the photosensitive drum 1 with the driving system of the main motor and rotates the drum. Further the primary CPU 50 causes the charger 41 and the discharger (not shown in the figure) to charge and discharge the photosensitive drum 1 repeatedly to regulate the conditions for image forming processes. These operations all belong to preprocessing. Further, in preprocessing, the user-determined number of continuous copies A is set in the primary counter CT1 by the predetermined key operation. (See Step F-2 in FIG. 2.)

As already explained above, the secondary CPU 60 always checks whether or not the Toner Concentration Detection signal sent from the toner concentration detecting means 63 is below 5 (wt %) and sends an Improper Toner Concentration signal (NG signal) when the concentration of the toner is below 5 wt % or a Proper Toner Concentration signal (OK signal) when the concentration of the toner is right to the Toner Concentration Judgement Result register R1 of the primary CPU 50. The primary CPU 50 reads a signal set in the register R1 (see Step F-3 in FIG. 2) and checks whether it is an NG signal (see Step F-4 in FIG. 2). If it is the NG signal, the primary CPU causes toner to be supplied (Step F-5) and goes to Step F-6. If the signal is an OK signal, the primary CPU directly goes to Step F-6 and checks whether the count value of the secondary counter CT is "0", that is whether the serial number of copies reaches the preset number of copies (1000 copies). If the serial number of copies does not reach 1000 copies, the primary CPU 50 goes to Step F-9. If the serial number of copies reaches 1000 copies, the primary CPU 50 sets the serial number of copies (1000 copies) in the secondary counter CT2 (Step F-7), generates an Image Concentration Control interrupt and outputs an Image Concentration Control Command signal to the secondary CPU 60 (Step F-8).

In response to the Image Concentration Control Command signal sent from the primary CPU 50, the secondary CPU 60 activates the optical scanning system 54, causes the light source to emit light beams toward the reference density plate, focuses the light beams reflected on the reference density plate to the photosensitive drum 1 by means of the primary and secondary mirrors (Step F-8 in FIG. 3). The secondary CPU 20 drives the developer 20 to make visible the electrostatic reference latent image as a reference toner image (Step F-82). Then, the secondary CPU 60 reads a reference image density corresponding to the Toner Concentration Detection signal sent from the toner concentration detecting means 63 from the lookup table T and sets it in the Reference Image Density register R2 (Step F-83).

The secondary CPU 60 fetches a real optical image density from the optical image density measuring means 61, compares it by the reference image density set in the Reference Image Density register R2 (Step F-84). If they do not match each other, the secondary CPU 60 checks whether the developing bias of the developing bias circuit 62 is the initial bias (Step F-85). If it is the initial bias, that is, if the developing bias remains unchanged, the secondary CPU 60 regulates the developing bias circuit 62, changes the developing bias (Step F-86), and returns. An example of changing the developing bias will be explained later. Contrarily, if the developing bias is not the initial one, that is, if the developing bias has been changed or if the actual optical image density has not been returned to the reference image density (as explained later), the secondary CPU 60 returns immediately.

If the secondary CPU 60 judges that the actual optical image density does not match the reference image density in Step F-84, the secondary CPU 60 checks whether the developing bias of the developing bias circuit 62 is the initial one (Step F-87). If the developing bias is not the initial one (which means that the actual optical image density returns to the reference image density after the developing bias was changed), the secondary CPU 60 regulates the developing bias circuit 62, changes the developing bias (Step F-88), and returns. Contrarily, if the developing bias is the initial one (which means that the actual optical image density has been matched with the reference image density and that the developing bias need not be changed), the secondary CPU 60 returns directly.

The primary CPU 50 runs the Image Formation program to execute an image forming process (Step F-9 in FIG. 2), decrements by one the count (the number of continuous copies) of the primary counter CT1 and the count (the serial number of copies) of the secondary counter CT2 (Step F-10), and checks whether the developing bias is the initial one (Step F-11). If the developing bias is the initial one, the primary CPU 50 checks whether the count of the primary counter CT1 is "0", that is, whether the number of continuous copies has reached the preset number of copies A (Step F-12). When the count of the primary counter CT1 is "0" and the preset number of continuous copies A has reached, the primary CPU ends the image forming process. If the preset number of continuous copies A has not reached, the primary CPU returns to Step F-3 to continue copying until the preset Number of copies A comes.

If the primary CPU 50 judges that the developing bias is not the initial one in Step F-11 (which means that the developing bias was changed by the secondary CPU 60 and that it has not returned to the initial one), the primary CPU decrements by one the count (the number of copies for judgement of bias recovery) of the tertiary counter CT3 and checks whether the count A (the number of continuous copies) of the primary counter CT1 is greater than the count B (the number of copies for judgement of bias recovery) of the tertiary counter CT3 (Step F-14). When the count A of the counter CT1 is greater than the count B of the counter CT3, the primary CPU 50 checks whether the count B of the counter CT3 is "0", that is, whether the preset number A of copies for judgement of bias recovery has reached (Step F-15). If the count B has not reached yet, it is apparent that the preset number A of continuous copies has not been made yet. So the primary CPU returns to Step F-9 to continue copying.

If the count B of the tertiary counter CT3 is "0" (which means that the preset count B (the number of copies for judgement of bias recovery) has come), the CPU sets the count B in the tertiary counter CT3 (Step F-16). The CPU returns to Step F-8 to return the developing bias to the initial one.

If the count A (the number of continuous copies) of the primary counter CT1 is smaller than the count B (the number of copies for judgement of bias recovery) of the tertiary counter CT3 in Step F-14, the primary CPU 50 checks whether the count A of the counter CT1 is "0", that is, whether the preset number A of continuous copies has reached (Step F-17). If the count A has not reached yet, the primary CPU 50 returns to Step F-9 to keep on copying until the preset count A comes. When the preset count A reaches, the primary CPU 50 ends the image formation process. In this case, this process ends with the current developing bias (not the initial one). However, it is reset to the initial one when the next continuous copying is made because Step F-13 and later steps are executed via Step F-11.

Resetting the developing bias to the initial one in Step F-88 of FIG. 3 is significant as explained below. As mentioned above, the primary CPU 50 executes the image formation process after the developing bias is changed by the secondary CPU 60. However if copying is made continuously with lower developing bias, the developing characteristics become too high. In this status, toner having higher charge quantity in the 2-component developing agent is consumed and the supply of new toner starts. The primary CPU 50 executes the Image Density Control program again when the preset number of copies (e.g., 50 copies) are made after the developing bias is changed so that the developing bias may return to the optimum value when the optical image density is on or close to the solid line A.

As seen from the above, the concentration of the toner is always monitored and regulated immediately when it reduces. The developing bias control is made each time 1000 copies are made. This intermittent bias control is substantially effective. The toner used to form a reference toner image is removed by the cleaner of the photosensitive drum 1. This is for saving of toner because the toner is not used for normal copying.

Below is explained the developing bias control operation by the secondary CPU 60 with reference with FIG. 3. In this figure, the developing bias comprises a.c. bias and d.c. bias components which are overlapped. The developing bias control is made by regulating the effective values of these a.c. and d.c. components while the a.c. frequency is fixed. In this control operation, a constant initial charge potential is applied to the photosensitive drum 1.

In the comparison operation in Step F-84, when an actual image density sent from the optical image density measuring means 61 is approximately equal to the reference image density stored in the Reference Density register R, the quantity of charge of the toner in the 2-component developing agent stored in the developer 20 is assumed to be right. The CD (Image Density) vs. Tc (Toner Concentration) curve is on or close to the solid line A in FIG. 5. In this status, a clear toner image can be formed on the photosensitive drum 1 efficiently. The image density of the toner image is in the range of about 0.4 to about 1.2 (meaning a wide contrast range) and the force of adhering the toner to the photosensitive drum 1 is so adequate that no image movement occurs in the image forming process. Therefore the developing bias need not be regulated. In this status, the d.c. component (VDC= −250 V), the peak-to-peak voltage of the a.c. component (Vp-p= 1500 V), and the a.c. frequency (fAC= 3 KHz) remain unchanged.

Figure 5:
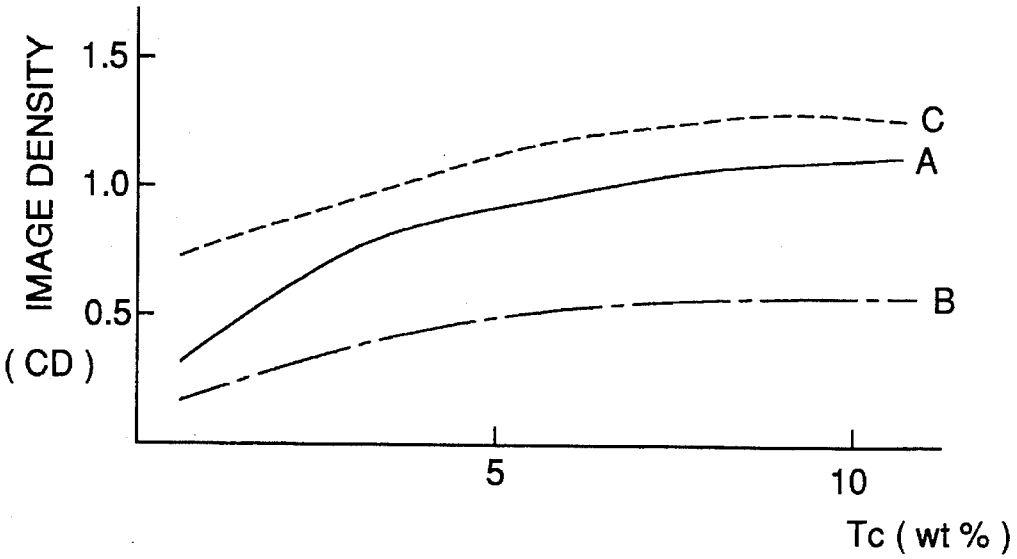
FIG. 5 shows how the image density CD changes as the quantity of toner charge Q/m (μC/g) of a 2-component developing agent stored in the developer.

If the actual image density falls greatly under the reference image density in the comparison operation in Step F-84, the quantity of toner charge becomes greater than the optimum value and is on the curve B (dashdot line) in FIG. 5. In this state, the image density and contrast are not satisfactory.

To increase the developing ability, the secondary CPU 60 controls the developing bias circuit 62 to make the d.c. component Vdc of the developing bias lower and the a.c. component Vac higher, that is, to set the d.c. component Vdc of 100 V, the peak-to-peak voltage of the a.c. component Vp-p of 2000 V, and the a.c. frequency fAC of −3 KHz. It seems as if the curve B (dash-dot line) is corrected to the curve A in FIG. 5. Thus the image can have optimum image density and contrast like those of the original image. In case the quantity of toner charge goes much higher than a preset level and the developing ability reduces, the developing ability can be recovered quickly if the a.c. bias is increased simultaneously. This is because the behavior of toner can be improved more efficiently by the increase of the peak-to-peak voltage Vp-p of the a.c. component than the change of the single d.c. component.

If the actual image density greatly goes up over the reference image density in the comparison operation in Step F-84, the quantity of toner charge becomes smaller than the optimum value and is on the-curve C (dotted line) in FIG. 5. In this state, the image density is too high and the image is far from the original one.

To reduce the developing ability, the secondary CPU 60 controls the developing bias circuit 62 to make the d.c. component Vdc of the developing bias higher and the a.c. component Vac lower, that is, to set the d.c. component Vdc of −350 V, the peak-to-peak voltage of the a.c. component Vp-p of 1200 V, and the a.c. frequency fAC of 3 KHz. It seems as if the curve C (dotted line) is corrected to the curve A in FIG. 5. Thus the image can have optimum image density and contrast like those of the original image. In this case, however, unwanted problems such as image spots and deviations may occur in the execution of the developing, transferring, and fixing processes. To prevent these problems, the secondary CPU 60 can execute the above bias control after sending a command to fully agitate the developing agent in the developer 20 to the primary CPU 50 and recognizing that the developing agent in the developer 20 is fully agitated.

As explained above, any change (reduction or increase) in the image density occurs although the concentration of toner is kept approximately at a preset level, the embodiment of this invention detects it, regulates the developing condition, and adjusts the developing ability. It is assumed as if the characteristics curve is corrected to the curve A in FIG. 2. Therefore, the resulting image can have the same image density and contrast as those of the original image.

Also in an inversion developing using another 2-component developing agent under optimum developing conditions of the initial charge potential VH of −600 V, the a.c. frequency of 5.0 KHz, the peak-to-peak voltage Vp-p of 2500 V, the developing bias Vdc of −500 V, and the toner concentration of 3.0 wt % +/−0.2 wt %, the same effect has been obtained by applying the similar control. In details, if the image density drops, the conditions are controlled to have the a.c. frequency of 4.0 KHz, the peak-to-peak voltage Vp-p of 2800 V, the developing bias Vdc of −550 V. If the image density is too high, the conditions are controlled to have the a.c. frequency of 5.0 KHz, the peak-to-peak voltage Vp-p of 2000 V, the developing bias Vdc of −450 V.

Further the same effect has been obtained also under the conditions of the initial charge potential VH of −800 V, the a.c. frequency of 3.0 KHz, the peak-to-peak voltage Vp-p of 2200 V, the developing bias Vdc of −600 V, and the toner concentration of 5.0 wt % +/− 0.3 wt %, by applying the similar control to set the peak-to-peak voltage Vp-p of 3000 V and the developing bias Vdc of −700 V or the peak-to-peak voltage Vp-p of 2000 V and the developing bias Vdc of −500 V.

In a color image developing device having a plurality of developers, color toners are consumed differently. This invention is preferentially applicable to a color image developing device using 2-component developing agents containing insulative carriers made of ferrite cores coated with plastic resin and developing in an a.c. electric field.

It should be understood that the present invention is not limited to the specific embodiments described in this specification. For example, in the image developing device in accordance with this invention, the toner concentration control and the developing bias control can be made by a single CPU.

As mentioned above, in the image recording device in accordance with this invention, any change (reduction or increase) in the image density occurring although the concentration of toner is kept approximately at a preset level is detected and the developing conditions are regulated according to the event so that the developed image can have optimum image density.

A colored image forming device in accordance with one embodiment of the present invention to attain the second purpose of the invention will be explained in detail with reference to the attached figures.

Figure 6:
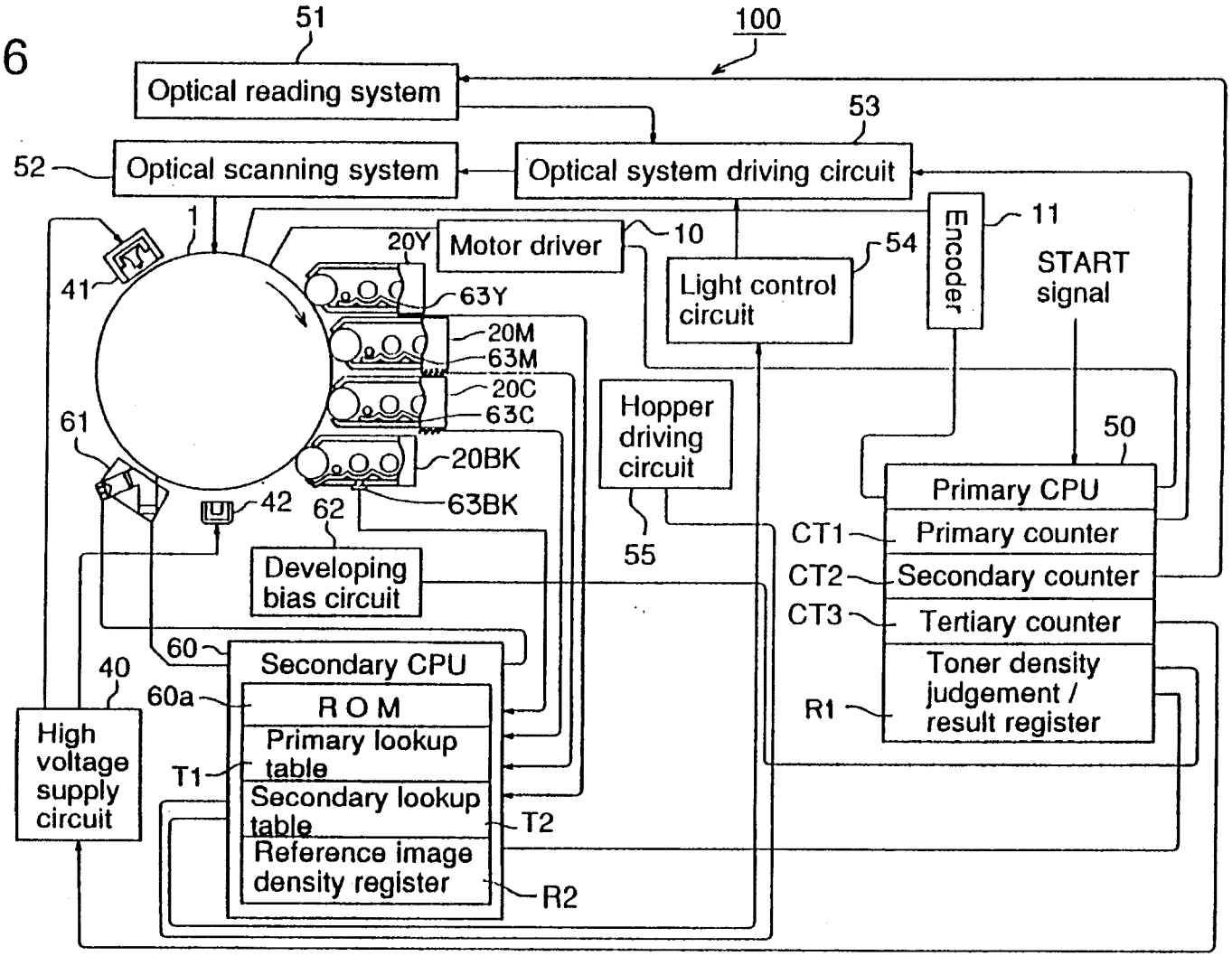
FIG. 6 is a block diagram of a color image recording device illustrating one embodiment of the present invention.

FIG. 6 is a block diagram of a colored image forming device illustrating one embodiment of the present invention. The colored image forming device 100 is equipped with a photo sensitive drum 1 working as a latent image carrier, a primary motor driver 10 controlling the rotation of the photosensitive drum 1, an encoder 11, four developers 20BK, 20C, 20M, and 20Y, a high-voltage power supply 40, a transfer 42, a charger 41, an optical reading system 51, an optical scanning system 52, an optical system driving circuit 53, a light quantity control circuit 54, a hopper driving circuit 55, a primary CPU 50, a secondary CPU 60, an optical image density measuring means 61, a developing bias circuit 62, and four toner concentration detecting means 63BK, 63C, 63M, and 63Y which are one-to-one related to the above four developers 20BK, 20C, 20M, and 20Y. Components having the same functions as those in FIG. 1 are assigned the same symbols as those in FIG. 1 and will not be explained here. 63Y, 63M, 63C and 63BK are respectively toner concentration detectors for yellow, magenta, cyan and black.

In FIG. 6, when a COPY button (not shown in this figure) is pressed, the primary CPU 50 causes the light source to emit light onto the photosensitive drum 1 according to an image signal representing the image density of the original document sent from the optical scanning system 52 to form an electrostatic latent image on the photosensitive surface of the photosensitive drum 1. This latent image is developed by the four developers 20BK, 20C, 20M, and 20Y in sequence. Thus a multi-color toner image (comprising a plurality of color layers) is formed on the photosensitive drum 1. The multi-color toner image is transferred to paper by the transfer 42 which is driven to discharge according to a resist signal. The toner image transferred to the paper is then fixed for permanent preservation. This colored image forming device employs three primary colors cyan C, magenta M, and yellow Y and a black. The other colors are reproduced by selecting and laminating these colors in the order of cyan C, magenta M, and yellow Y (from bottom to top). These color toner layers can be accumulated for example on the transfer drum instead of the photosensitive drum 1.

The photosensitive drum 1 is the same aluminum conductive drum as the OPC photosensitive drum in FIG. 1 except that this drum is 150 mm in diameter.

The latent image carrier is not limited to the above photo-sensitive drum 1. For instance, it can be of the belt type.

There are two types of digital optical scanning system: a system using a method of reading light beams reflected on a document placed on the document glass plate, focusing them to the light receiving part of the solid image-picking element, and causing the image picking element to output an image information signal to the optical system driving circuit 53 and a system of storing image data of the reference density part in memory and forming a reference image according to this data.

The digital type optical scanning system can be classified into three according to methods of modulation: laser light modulation, magnitude modulation, and pulse-width modulation. The magnitude modulation method is to control the magnitude of laser light by adjusting a current applied to a semiconductor laser and the like. The pulse-width modulation method is to control the quantity of laser light (area of illumination per pixel) by adjusting the slice level of the reference wave.

The optical system driving circuit 53 contains a circuit to control a mechanism such as a polygonal mirror and an image processing circuit which processes an image signal sent from the optical reading system 51. This circuit 53 works to store data of reference image density which changes stepwise or continuously in the range of optical reflection density of 0 to 1.0 in ROM and to control the optical scanning system 52 to form a reference latent image according to this data. In this embodiment, the reference image density data is equivalent to the optical reflection density of 1.0, but not limited to this.

The light quantity control circuit 54 is a circuit to control a current flowing through a semiconductor laser constituting a part the optical system driving circuit 53 in the magnitude modulation method or a circuit to control the slice level of the reference wave in the pulse-width modulation method.

The developers 20BK (for black toner), 20C (for cyan toner), 20M (for magenta toner), and 20Y (for yellow toner) are identical except that they differ in color of toner components of the 2-component developing agents that they contain. Each of the developers 20BK, 20C, 20M, and 20Y is functionally the same as the developer 20 in FIG. 1.

In FIG. 7, each developer 20*a* is equipped with a toner supply port 20*h* which is connected to a toner hopper (not shown in this figure) through which toner is sent into the developer by a toner conveying screw (not shown in the figure) driven by the hopper driving circuit 55 according to a Toner Supply signal.

The developing bias circuit 62 can change the developing bias by a control signal sent from the secondary CPU 60.

The high voltage power supply circuit 40 is a circuit to apply a predetermined high voltage to the device 42 and the charger 41. It is so constructed as to change the initial charge potential of the photosensitive drum 1 by changing a voltage applied to the charger 41 under control of the secondary CPU 60.

The optical density measuring means 61 comprises a tungsten lamp working as a light source, a light receiving unit such as a photodiode that receives a light reflected from a reference toner image formed on the photosensitive drum 1, and blue, green, and red filters covering the whole surface of the light receiving unit. These filters are selected according to the color contained in the image density signal. The optical density measuring means is not limited to the above. It can use blue, green, and red indicators as the light sources without using the above three filters covering the whole surface of the light receiving unit.

The toner concentration detecting means 63BK, 63C, 63M, and 63Y which are one-to-one provided in the developers 20BK, 20C, 20M, and 20Y respectively detect the concentration of a toner component of the 2-component developing agent stored in each developer by a change in magnetic permeability of each 2-component developing agent. The toner concentration detecting means is not limited to the above. It can be such a means that detects the concentration of toner by the volume level of the 2-component developing agent. For convenience, the explanation below is made using a toner concentration detecting means that detects the concentration of toner by a change in magnetic permeability.

The primary CPU 50 which sequentially controls the image forming processes contains an Image Formation program to execute the image forming processes. When the COPY button is pressed, a START signal generates and starts the Image Formation program to execute the image forming processes.

The secondary CPU 60 stores a primary lookup table T1 that one-to-one relates image densities CD to toner concentrations Tc at an optimum quantity of toner charge, a secondary lookup table T2 that one-to-one relates image densities CD to developing potential gaps at an optimum toner charge quantity, and an Image Density Control program consisting of a Toner Concentration Judgement subprogram and a Developing Potential Gap Control program in the built-in ROM 60*a*. The developing potential gap means the potential difference (VII–VB) between the initial charge potential (VII) and the developing bias VB in the normal developing method or the potential difference (VB–VL) between the developing bias VB and the potential VL in the exposure part in the reverse developing method.

The Toner Concentration Judgement program checks whether or not the toner concentration detected by each toner concentration detecting means (63BK, 63C, 63M, or 63Y) falls under a predetermined value and sends an Improper Toner Concentration signal (NG signal i.e. Not Good) when the concentration of the toner is below the preset level or a Proper Toner Concentration signal (OK signal) when the concentration of the toner is right to the primary CPU 50. The primary CPU 50 contains a Toner Concentration Judgement Result register R1 which sets an NG or OK signal for each color sent from the secondary CPU 60. When an NG signal is set in the register R1, the primary CPU 50 causes the toner to be supplied from the corresponding toner hopper to the the corresponding developer 20*a* to keep constant the concentration of the toner in the corresponding 2-component developing agent.

The Developing Bias Control program detects an increase or decrease of the image density of a certain color(s) in the detection signals sent from the optical density detecting means 61 although the concentration of each color toner is kept in the predetermined level and controls the related developing potential gap with reference to the secondary lookup table to keep the image density in its predetermined level. A decrease or increase of the image density is judged by detecting the image density of the light reflected from a toner image (made by the reference density plate) on the photosensitive drum 1 and comparing it by the reference image density CD of about 1.0 (equivalent to toner concentration Tc of 7.5 wt %) read from the primary lookup table T1. In this case, the reference image density is set in the Reference Image Density register R2.

Figure 8A:
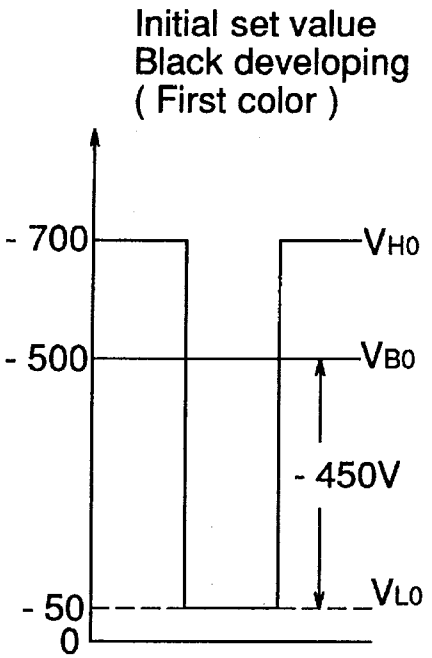
FIGS. 8*a*–8*d* show examples of initial developing potential gaps and their changes.
Figure 8B:
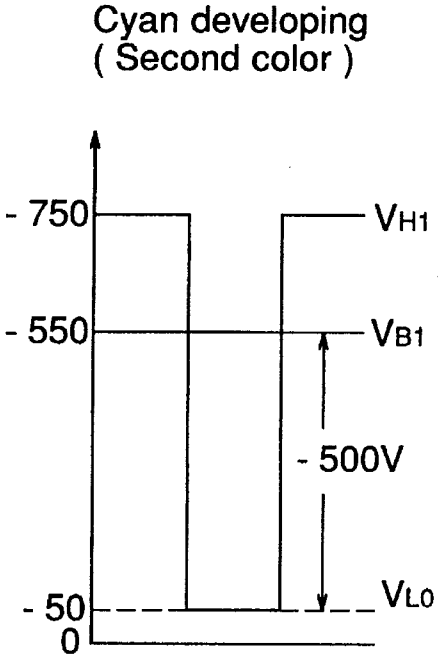
Figure 8C:
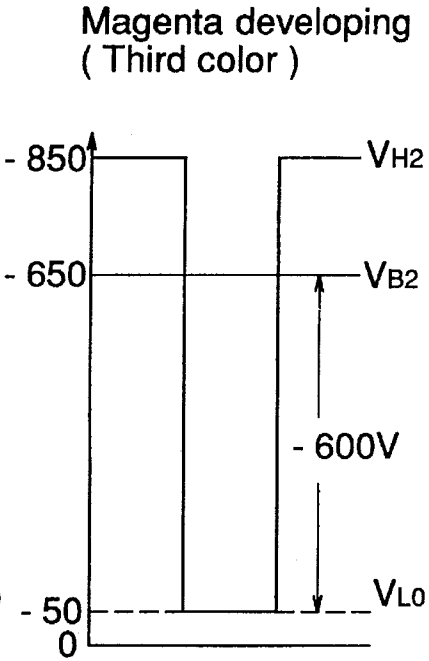
Figure 8D:
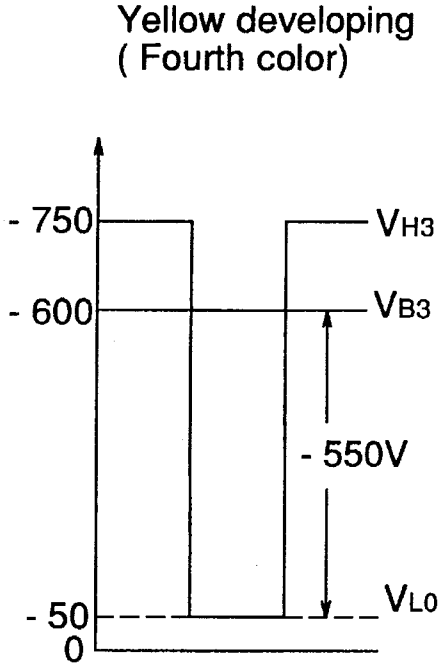

FIGS. 8*a*–8*d* illustrate electrostatic process conditions (developing potential gaps) under which a latent image for formation of each color toner image is formed on the photosensitive drum in the reverse developing method. FIG. 8*a* shows the initial electrostatic process condition in which the quantity of charge of each color toner is adequate as a new 2-component developing agent is loaded. To make more concrete, the condition is the initial charge potential VII0 of −700 V, the developing bias VB0 of −500 V, the potential VL0 in the exposure part of −50 V, and the developing potential gap VB0− VL0 of −450 V. FIG. 8*b* illustrates electrostatic process conditions to recover an adequate developing ability in case the developing ability reduces as the charge quantity of cyan or yellow toner increases in the progress of continuous copying. To make more concrete, the reduction in the developing ability due to increase of charge quantity of cyan or yellow is cancelled by setting the conditions of, for example, the initial charge potential VII1 of −750 V, the developing bias VB1 of −550 V, the potential VL0 in the exposure part of −50 V, and the developing potential gap VB1− VL0 of −500 V. FIG. 8*c* illustrates electrostatic process conditions to recover an adequate developing ability in case the developing ability reduces as the charge quantity of magenta toner increases in the progress of continuous copying. To make more concrete, the reduction in the developing ability due to increase of charge quantity of magenta is cancelled by setting the conditions of, for example, the initial charge potential VII2 of −850 V, the developing bias VB2 of −650 V, the potential VL0 in the exposure part of −50 V, and the developing potential gap VB2−VL0 of −600 V.

The primary CPU 50 contains three counters CT1, CT2, and CT3 to count the numbers of copies in it. The primary counter CT1 counts the number of copies which are made continuously according to detection signals sent from sensors (e.g., paper ejection sensor). The secondary counter CT2 counts the number of copies indicating timing of execution of the Developing Bias Control program, that is the serial number of copies after the last developing bias control was made. To make more concrete, the Developing Potential Gap Control program is executed each time one thousand copies are made. The tertiary counter CT3 counts the number of copies indicating timing of judging whether or not the image density returns to the predetermined level by the execution of the Developing Potential Gap Control program, that is timing for judgement of recovery of a developing potential gap. To make more concrete, the primary CPU checks whether the image density returns to the predetermined level when fifty copies are made after the Developing Potential Gap Control program was executed and returns the developing potential gap to the initial value according to the judgement. The counters CT1, CT2, and CT3 are decremental counters and have their initial values (number of continuous copies, serial number of copies, and number of copies for potential gap return judgement). When the count of each counter reaches "0", it is assumed that a predetermined number of copies are made.

Figure 10:
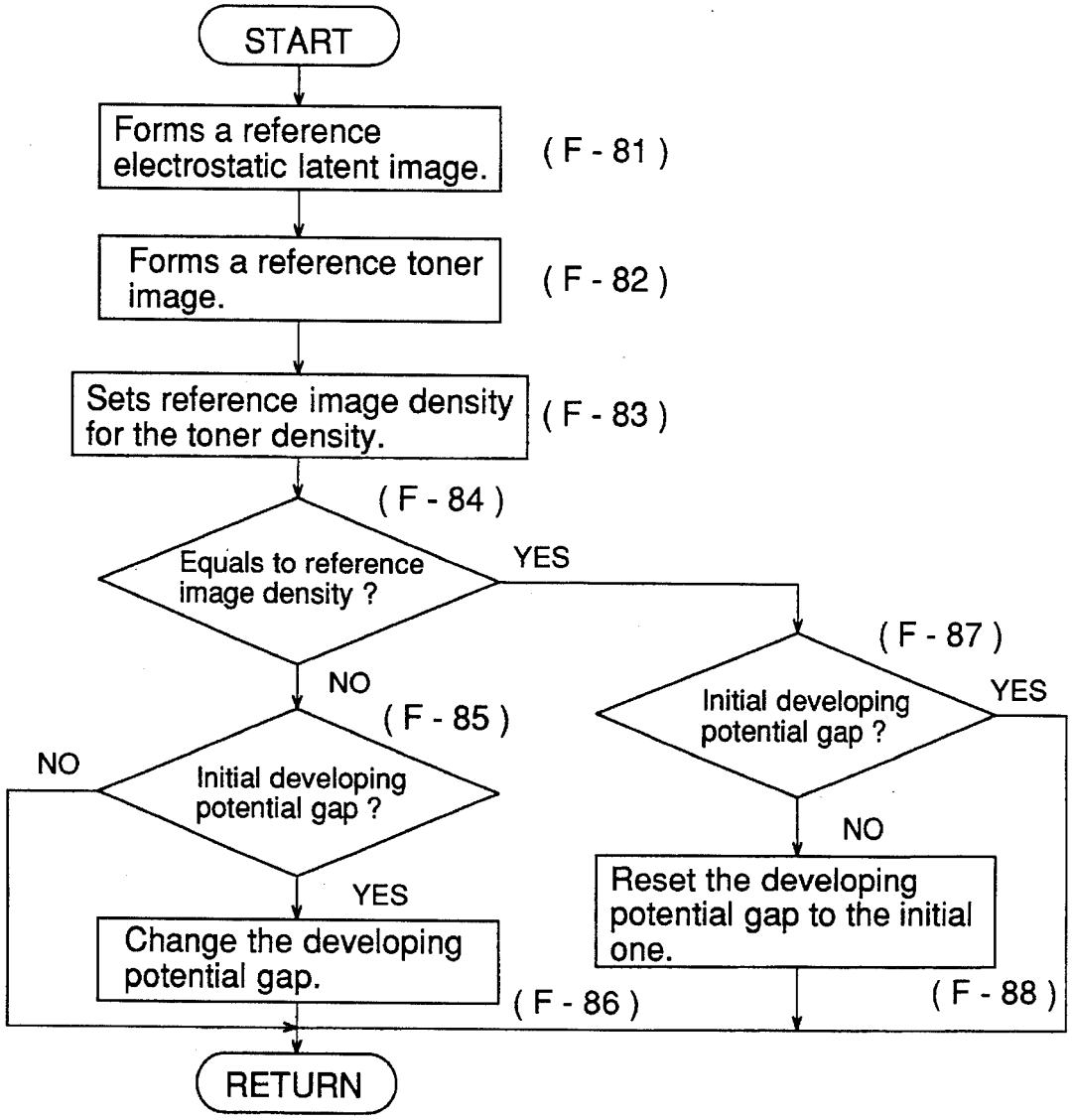
FIG. 10 is a flow chart of the image concentration controlling operation of an image recording device in accordance with the present invention.

The image forming operation of the image forming device of the present invention is explained below with reference to FIG. 9 and FIG. 10. FIG. 9 shows the main flow of the image forming operation executed by the primary CPU 50 and FIG. 10 is a flow of the developing potential gap control operation executed by the secondary CPU 60.

When the main switch (not shown in the figures) is pressed, the image forming device is powered on and both primary and secondary CPUs start to run. (See Step F-1 in FIG. 9.)

The primary CPU 50 actuates the motor driver 10 to start the main motor. The main motor rotates the primary and secondary agitating rollers 20*e* and 20*f* in each of the developers 20BK, 20C, 20M, and 20Y. The 2-component developing agent is agitated by these rollers. At the same time, the heater of the fixer (not shown in the figure) is heated to a predetermined temperature. The primary CPU 50 engages the photosensitive drum 1 with the driving system of the main motor and rotates the drum. Further the primary CPU 50 causes the charger 41 and the discharger (not shown in the figure) to charge and discharge the photosensitive drum 1 repeatedly to regulate the conditions for image forming processes. These operations all belong to preprocessing. Further, in preprocessing, the user-determined number of continuous copies A is set in the primary counter CT1 by the predetermined key operation. (See Step F-2 in FIG. 9.)

As already explained above, the secondary CPU 60 always checks whether or not the Toner Concentration Detection signal sent from each of the toner concentration detecting means 63BK, 63C, 63M, and 63Y is below a preset value of 7.5 (wt %) and sends an Improper Toner Concentration signal (NG signal) when the concentration of the toner is below 7.5 wt % or a Proper Toner Concentration signal (OK signal) when the concentration of the toner is not below 7.5% to the Toner Concentration Judgement Result register R1 of the primary CPU 50.

The primary CPU 50 reads a signal set in the register R1 (see Step F-3 in FIG. 9) and checks whether there is a color for which an NG signal is given (see Step F-4 in FIG. 9). If there is such a color, the primary CPU causes the toner of the color to be supplied (Step F-5) and goes to Step F-6. If all colors are given an OK signal, the primary CPU directly goes to Step F-6 and checks whether the count value of the secondary counter CT2 is "0", that is whether the serial number of copies reaches the preset number of copies (1000 copies). If the serial number of copies does not reach 1000 copies, the primary CPU 50 goes to Step F-9. If the serial number of copies reaches 1000 copies, the primary CPU 50 sets the serial number of copies (1000 copies) in the secondary counter CT2 (Step F-7), generates an Image Concentration Control interrupt and outputs an Image Concentration Control Command signal to the secondary CPU 60 (Step F-8).

In response to the Image Concentration Control Command signal sent from the primary CPU 50, the secondary CPU 60 activates the optical scanning system 52 and causes the optical scanning system to form a reference electrostatic latent image (exposure part) of each color equivalent to the optical reflection density CD of 1.0 on the photosensitive drum 1 in sequence. (See Step F-81 in FIG. 10.) The secondary CPU 60 drives each of the developers 20BK, 20C, 20M, and 20Y to make visible each electrostatic reference latent image for each color as a reference toner image of each color (Step F-82). Then, the secondary CPU 60 reads a reference image density corresponding to the Toner Concentration Detection signal sent from each of the toner concentration detecting means 63BK, 63C, 63M, and 63Y from the lookup table T1 and sets it in the Reference Image Density register R2 (Step F-83).

The secondary CPU 60 starts the optical image density measuring means 61 and fetches a real optical image density of each color from the means 61, compares it by the reference image density of the corresponding color set in the Reference Image Density register R2 to check whether they match each other, that is, whether or not there is a color whose developing ability has reduced (Step F-84). If detecting a color whose developing ability has reduced, the secondary CPU 60 checks whether the developing potential gap of the color is the initial one (Step F-85). If it is the initial value, that is, if the developing potential gap of the color remains unchanged, the secondary CPU 60 reads the quantity of change of the developing potential gap corresponding to the actual optical image density from the secondary lookup table T2 (Step F-86). The secondary CPU 60 changes the developing potential gap according to the offset of the read developing potential gap (Step F-87) and returns. This potential gap change is made by adjusting the initial charge potential VII of the photosensitive drum 1 by the high voltage power supply 40 and the charger 41, the quantity of light by the light quantity control circuit 54, and the developing bias VII by the developing bias circuit 62. These adjustments will be explained in detail later.

Contrarily, if the developing potential gap is not the initial one (which means that the developing potential gap was changed but the developing ability has not been recovered yet), the secondary CPU 60 returns immediately. Note that this immediate return will be made after Step F-85 and Step F-86 are performed on all colors whose developing abilities are reduced.

In Step F-84, when judging that the developing abilities of all colors are normal, the secondary CPU 60 checks whether the developing potential gap of every color is the initial one (Step F-88). If there is a color whose developing potential gap is not the initial one (which means that the developing ability has recovered by the change of the developing potential gap), the secondary CPU 60 resets the developing potential gap to the initial one (Step F-89) and returns. Contrarily, when the developing potential gaps of all colors are the initial ones (which means that the developing abilities of all colors remain normal), the secondary CPU 60 returns directly as they need not be changed.

The primary CPU 50 runs the Image Formation program to execute an image forming process (Step F-9 in FIG. 9), decrements by one the count (the number of continuous copies) of the primary counter CT1 and the count (the serial number of copies) of the secondary counter CT2 (Step F-10), and checks whether the developing potential gap of each color is the initial one (Step F-11). If the developing potential gaps of all colors are the initial ones, the primary CPU 50 checks whether the count of the primary counter CT1 is "0", that is, whether the number of continuous copies has reached the preset number of copies A (Step F-12). When the count of the primary counter CT1 is "0" and the preset number of continuous copies A has reached, the primary CPU ends the image forming process. If the preset number of continuous copies A has not reached, the primary CPU returns to Step F-3 to continue copying until the preset number of copies A comes.

If judging that there is a color(s) whose developing potential gap is not the initial one in Step F-11 (which means that the developing potential gap was changed by the secondary CPU 60 but there is a color whose developing potential gap has not been returned to the initial one), the primary CPU 50 decrements by one the count (the number of copies for judgement of potential gap recovery) of the tertiary counter CT3 and then checks whether the count A (the number of continuous copies) of the primary counter CT1 is greater than the count B (the number of copies for judgement of potential gap recovery) of the tertiary counter CT3 (Step F-14). As a result, when the count A of the counter CT1 is greater than the count B of the counter CT3, the primary CPU 50 checks whether the count B of the counter CT3 is "0", that is, whether the preset number A of copies for judgement of potential gap recovery has reached (Step F-15). If the count B has not reached yet, it is apparent that the preset number A of continuous copies has not been made yet. So the primary CPU returns to Step F-9 to continue copying.

If the count B of the tertiary counter CT3 is "0" (,which means that the preset count B (the number of copies for judgement of potential gap recovery) has come), the CPU sets the count B in the tertiary counter CT3 (Step F-16). The CPU returns to Step F-8 to return the developing potential gap to the initial one.

If the count A (the number of continuous copies) of the primary counter CT1 is smaller than the count B (the number of copies for judgement of potential gap recovery) of the tertiary counter CT3 in Step F-14, the primary CPU 50 checks whether the count A of the counter CT1 is "0", that is, whether the preset number A of continuous copies has reached (Step F-17). If the count A has not reached yet, the primary CPU 50 returns to Step F-9 to keep on copying until the preset count A comes. When the preset count A reaches, the primary CPU 50 ends the image formation process. In this case, this process ends with the current developing potential gap (not the initial one). However, it is reset to the initial one when the next continuous copying is made because Step F-13 and later steps are executed via Step F-11.

Resetting the developing potential gap to the initial one in Step F-88 of FIG. 10 is significant as explained below. As mentioned above, the primary CPU 50 executes the image formation process after the developing potential gap is changed by the secondary CPU 60. However, if copying advances with lower developing potential gap, the developing characteristics become too high. In this status, toner having higher charge quantity in the 2-component developing agent is consumed and the supply of new toner starts. The primary CPU 50 executes the Image Density Control program again when the preset number of copies (e.g., 50 copies) are made after the developing potential gap is changed. Thus the changed developing potential gap is reset to the initial value after the optimum developing characteristics are recovered.

Below is explained the developing potential gap control operation in reverse development by the secondary CPU 60 with reference to FIG. 10. This embodiment controls to maintain the toner concentration of 7.5 wt % +/−0.5 wt %, assuming that the photosensitive drum 1 is equipped with an OPC photosensitive layer over it and the developing agent is a 2-component developing agent comprising a carrier component (magnetic particles coated with insulative resin; particle size of 40 μm) and a toner component (particle size of 8.5 μm). This embodiment uses the developing bias comprises only a d.c. component and controls the output of the semiconductor laser, the initial charge potential VII, and the developing bias VB while the potential in the exposure part VL is fixed to −50 V.

In the comparison operation in Step F-84, when the data of measurement sent from the optical reflection density measuring means 61 is approximately equal to the reference image density stored in the Reference Density register R, the quantity of charge of the toner in the 2-component developing agent stored in the developer 20 is assumed to be right (Q/m= −25 μC/g). The developing potential gap VB0–VL0 is −450 V at the developing image density CD of 1.0. In this status, the charge quantity of each color toner is just of very close to an optimum value. The electrostatic process conditions of the colors are identical when fresh developing agents are loaded. As stated above, when the measured data matches the reference data, the developing potential gap VB0–VL0 need not be adjusted. Therefore, the electrostatic process conditions for the developing image density CD of 1.0 are the initial electrostatic charge potential VII0 of −700 V, the potential in the exposure part VL0 of −50 V, the developing bias VB0 of −500 V, the developing potential gap VB0–VL0 of −450 V, and the semiconductor laser output LD of 1.2 mW. These electrostatic process conditions are the initial ones.

In this status, a clear toner image can be formed on the photosensitive drum 1 efficiently. The image density of the toner image is in the range of about 0.4 to about 1.2 (meaning a wide contrast range) and the force of adhering the toner to the photosensitive drum 1 is so adequate that no image movement occurs in the image forming process. This is also applicable to the other colors.

In the comparison operation in Step F-84, if the data of measurement sent from the optical image density measuring means 61BK, 61C, 61M, or 61Y falls greatly under the reference data stored in the register, the quantity of charge of the toner is assumed to be greater than the optimum value Q/m= −25 μC/g. (For example, the toner charge quantity is about −30 μC/g or more.) In this status, the developing potential gap must be increased to get images of satisfactory image density and contrast.

To increase the developing ability, the secondary CPU 60 controls the light quantity control means 54 and the developing bias circuit 62 and increases the developing potential gap VB VL. To make more concrete, the developing ability of the black color is increased as explained above. To increase the developing ability of cyan and yellow colors, set the following electrostatic process conditions at the developing image density CD of 1.0 (with reference to FIG. 8*b* and FIG. 8*d*): the initial charge potential VII1 of −750 V, the potential in the exposure part VL0 of −50 V, cyan developing bias VB1 of −550 V, yellow developing bias VB3 of −600 V, and the semiconductor laser output LD of 1.5 mW. As for the magenta color, set the following electrostatic process conditions (with reference to FIG. 8*c*): the initial charge potential VII2 of −850 V, the potential in the exposure part VL0 of −50 V, magenta developing bias VB2 of −650 V, and the semiconductor laser output LD of 1.8 mW. (Step F-74) With the above conditions, the developing abilities for cyan, yellow, and magenta can be increased higher than those of initial conditions. Therefore the developing abilities in respective developing processes are corrected. In developing, the amount of yellow toner (in the upper layer) to be controlled should be greater than the amount of cyan toner (in the lower layer) to be controlled.

Figure 11A:
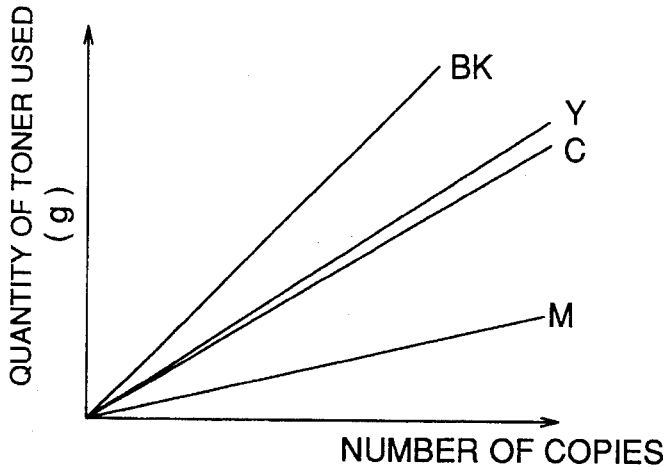
FIG. 11*a* shows how much each color toner is consumed as copying advances.
Figure 11B:
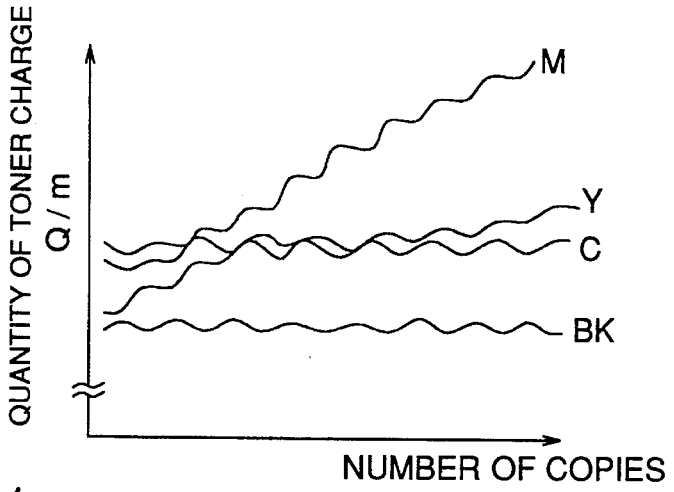
FIG. 11*b* shows how much each color toner is charged in formation of color image as copying advances.
Figure 11C:
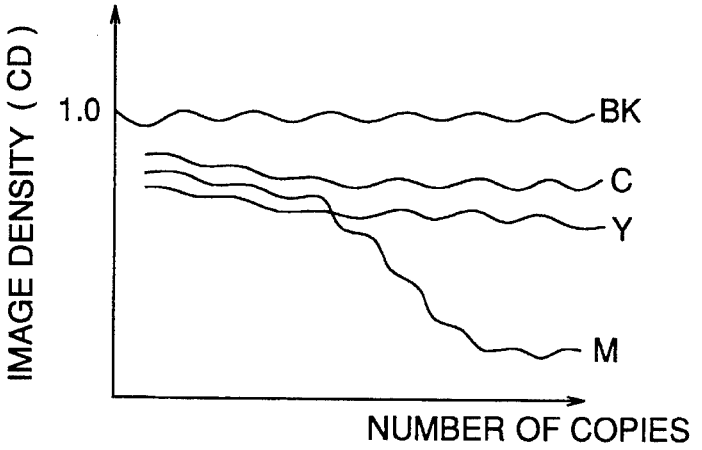
FIG.11*c* shows how the image density of each color toner used for formation of a colored image varies as copying advances.

Accordingly, even when the developing ability goes down, the color reproduction of a colored document can be corrected and we can obtain colored images of high color reproduction, satisfactory image density and contrast. Potential gaps given in FIGS. 8*a*–8*d* are for the cases that the image densities (or developing forces) of colors reduce as shown in FIG. 11*c*. In other words, FIGS. 8*a*–8*d* indicate that the developing potential gap VB–VL of each color is increased according to the degree of reduction of the amount of the adhered toner.

As the color image forming device in accordance with this embodiment employs a process of accumulating a plurality of toner layers on the photosensitive drum 1, it sometimes happens that the developing force of the upper layer is reduced by a toner potential of the lower toner layer which was formed earlier on the photosensitive drum 1. In such a case (as shown in the case the developing forces of cyan and yellow toners go down), we have found that it is advantageous to make a little stronger the developing force in the development by the toner developer 20Y containing yellow toner to be developed after the cyan toner is developed. The similar effect is obtained also in adjustment of the size of respective dot exposure parts (latent image areas) by the light quantity control circuit 54 in the pulse-width modulation method in the optical scanning system 52 using a semiconductor laser as the light source.

As explained above, any change (reduction or increase) in the image density occurs although the concentration of toner is kept approximately at a preset level, the embodiment of this invention detects it, controls the electrostatic process conditions (charge potential, exposure intensity or quantity, developing bias, etc.) so that the developing potential gap may be constant, and thus adjusts the developing force. Therefore, the resulting image can have the same image density, contrast, and color balance as those of the original image.

As mentioned above, in the color image recording device in accordance with this invention, any change (reduction or increase) in the color image density occurring although the concentrations of toners are kept approximately at preset levels is detected and the electrostatic process conditions are controlled to be optimum. Thus, color images of optimum image densities can be obtained.

Figure 12A:
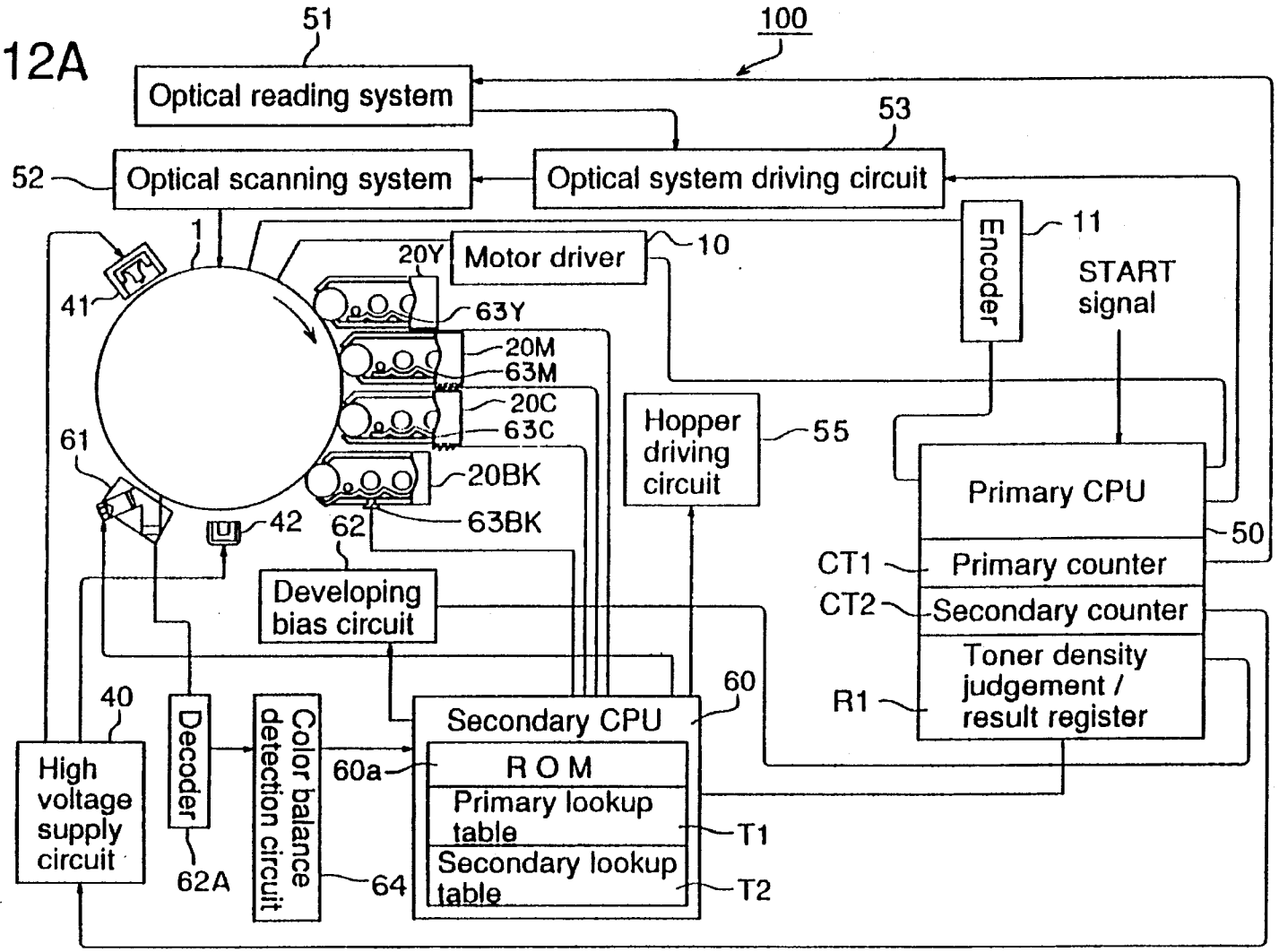
FIG. 12A is an approximate block diagram of an image recording device illustrating one embodiment of the present invention.

FIG. 12A is a block diagram of a color image recording device illustrating one embodiment of the present invention to attain the second purpose of the invention. The color image recording device 100 is equipped with a photosensitive drum 1 working as a latent image carrier, a motor driver 10 controlling the operation of a motor M that rotates the photosensitive drum 1, an encoder 11, four developers 20BK, 20C, 20M, and 20Y, a high voltage power supply 40, a transfer 42, a charger 41, a primary CPU 50, an optical reading system 51, an optical scanning system 52, an optical system driving circuit 53, a hopper driving circuit 55, a secondary CPU 60 including a primary lookup table T1 and a secondary lookup table T2, an optical image density measuring means 61Y, 61M, 61C and 61BK, for respectively measuring the yellow, magenta, cyan and black light separated from the superimposed image, a decoder 62A, a color balance detecting circuit 64, a developing bias circuit 62, and four toner concentration detecting means 63BK, 65C, 63M, and 63Y which are one-to-one related to the above four developers 20BK, 20C, 20M, and 20Y. Components having the same functions as those in FIG. 6 are assigned the same symbols as those in FIG. 6 and will not be explained here.

Figure 12B:
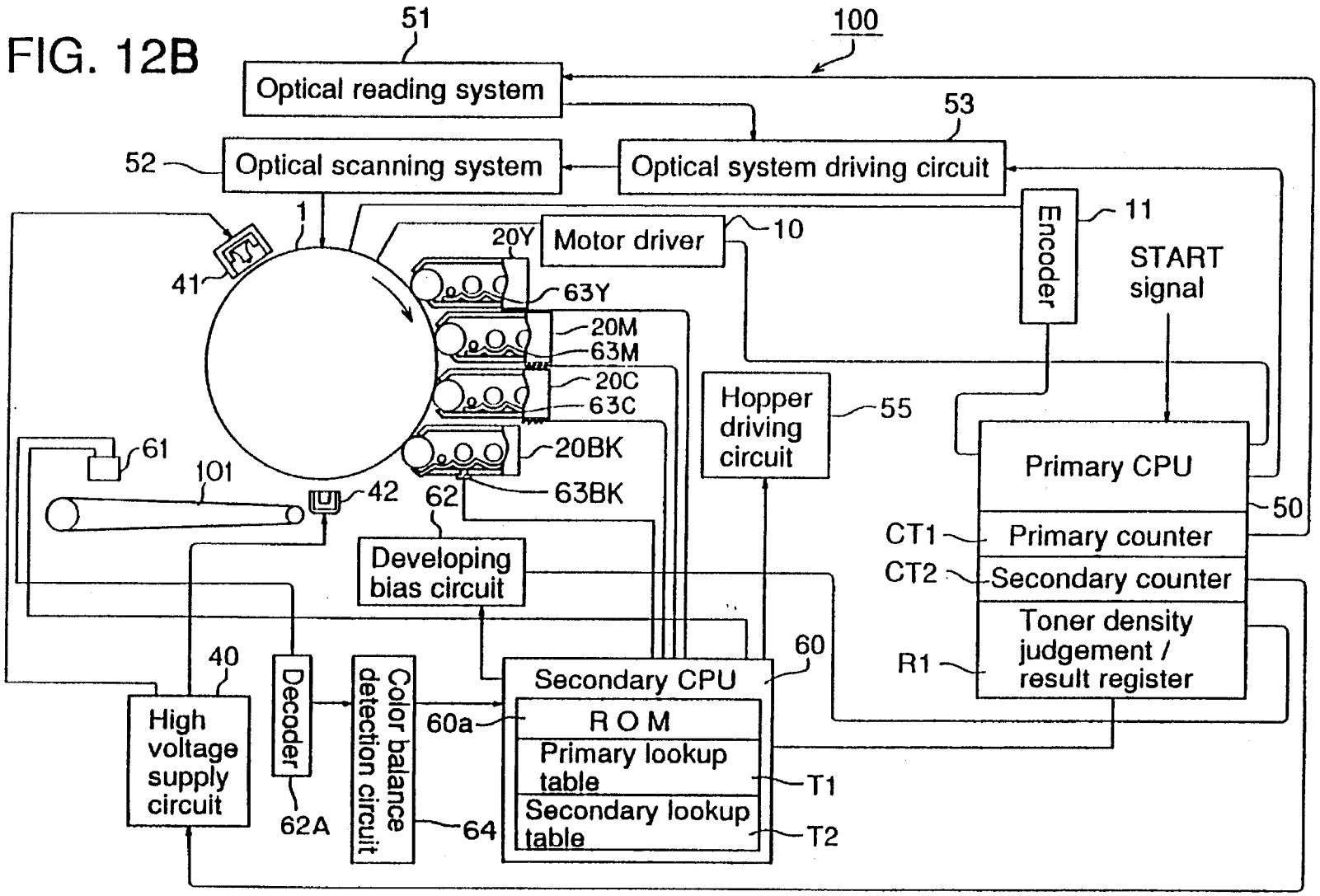
FIG. 12B is a modified embodiment of FIG. 12A wherein the detector 61 is positioned along a conveyance path.

FIG. 12B is a modified embodiment of FIG. 12A wherein the detector 61 is positioned above the conveyance belt 101. In FIG. 12B the recording medium is conveyed from the transfer section 42 to the fixing section by the conveyor belt 101, and in the course of this conveyance the color balance of the superimposed toner image on the recording medium can be detected by the detector 61.

Figure 13:
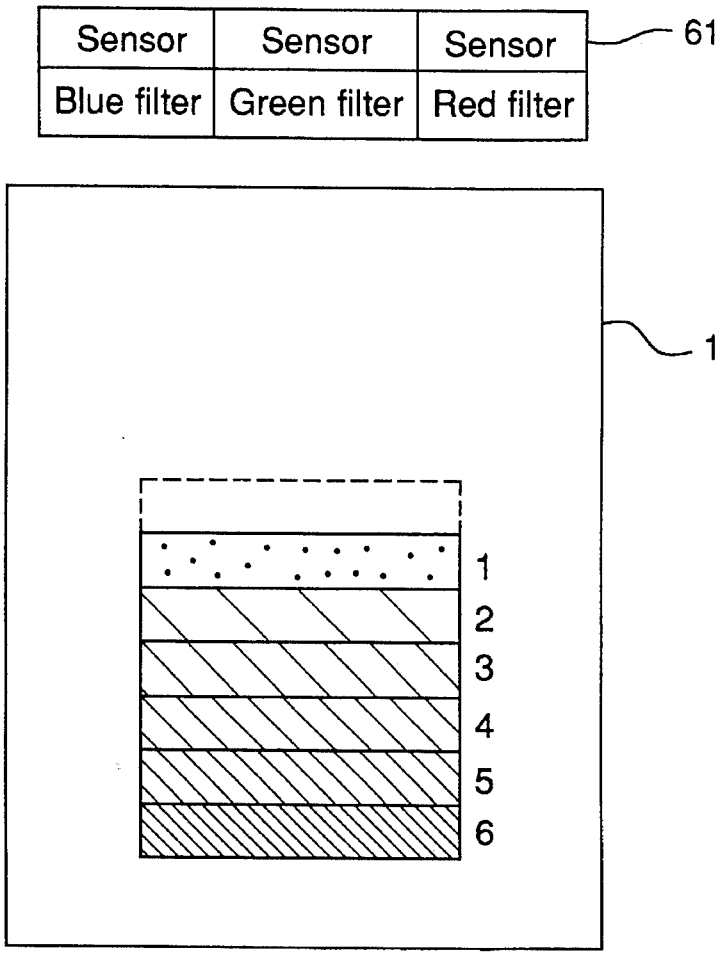
FIG. 13 shows a 3-color reference toner image having six density levels formed on the surface of the photosensitive drum.
Figure 14:
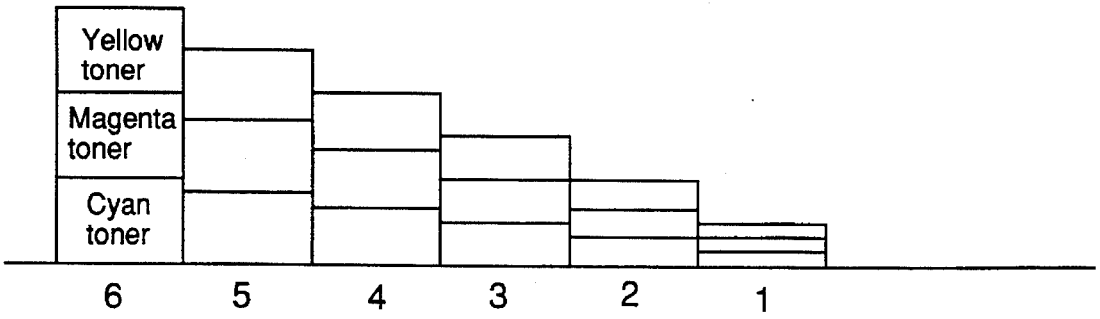
FIG. 14 shows a model representing how the color toner layers are laminated in a 3-color reference toner image.

In this embodiment, reference cyan, magenta, and yellow toner images are formed with any of six gray density levels (level 1 to level 6) as shown in FIG. 13. When the charge quantity of each color toner is right, the quantity of an attached color toner becomes greater as the gray level goes higher as shown in FIG. 14. In any gray level, the quantities of cyan, magenta, and yellow toners attached are identical and they look gray to you. However, if the quantities of the attached color toners are not identical in a three-color reference toner image, the color reproduction is not satisfactory because of color unbalance. The details of this will be explained later.

The color balance is checked by the separated color light detecting means 61, the decoder 62A, and the color balance detecting circuit 64 under control of the secondary CPU 60.

The separated color light detecting means 61 receives separated color lights reflected on the 3-color reference toner image, converts them into electric signals, and outputs the signals. The separated color light detecting means 61 consists of a light source (e.g., a tungsten lamp), a light receiving unit containing three photosensors, and blue (B), green (G), and red (R) filters one-to-one placed before the photo sensors. Light emitted by the tungsten lamp are reflected on the 3-color reference toner image, filtered into three color lights by the color filters B, G, and R, and received by the photosensors placed behind the filters. The photosensors convert the lights into corresponding electric signals and output blue, green, and red signals. At the same time, the separated color light detecting means 61 outputs color separation signals of all 3-color reference toner images of gray density levels Level 1 to Level 6 sequentially. The separated color light detecting means 61 is not limited to the above. It can employ three blue, green, and red light emitting diodes (LEDs) as the light source and omit the three blue, green, and red filters placed before the light receiving part. Further, the separated color light detecting means 61 can comprise a tungsten lamp as a light source, a photosensor, and three blue, green, and red filters placed before the photosensor, in which these three color filters are exchanged so that blue, green, and red colors may be separately received by the photosensor. Furthermore, the means 61 can use three blue, green, and red light emitting diodes (LEDs) as the light source and a single photosensor. In case a white lamp is used, the filters can be cyan, magenta, and yellow filters which are equivalent to the color toners used. This is because the accuracy of detection of color lights increases as the spectral characteristics of toners becomes closer to those of the color filters.

The decoder 62A receives analog electric signals representing densities of colors from the separated color light detecting means 61, corrects black and white levels of the signals, converts them into, for example, 2-bit digital electric signals, and outputs them as color codes (blue code IB, green code IG, and red code IR) to the color balance detection circuit 64.

The color balance detecting circuit 64 receives signals (blue code IB, green code IG, and red code IR) from the decoder 62, compares them by the stored quantities of color toners for each gray level in good color balance (same as those of the above digital electric signals), checks whether the color balance is good, judges the color which the gray looks like if the color balance is not good, and outputs the result to the secondary CPU 60.

FIG. 15 illustrates the relationship between the contents of color codes (blue code IB, green code IG, and red code IR) and color balance status at gray density levels Level 3 and Level 6. In FIG. 15, the content of each color code (blue code IB, green code IG, and red code IR) representing the density level of each color is expressed in binary. The toner density increases in the order of "00" (No Toner), "01", "10", and "11".

Case C1: The reference toner images of Level 2 and Level 3 look reddish. This case indicates that the quantity of the adhered cyan toner C is less than that of each of the other color toners (magenta toner M and yellow toner Y). In this case, if the quantities of the other color toners (magenta toner M and yellow toner Y) that are adhered are right, the quantity of the adhered cyan toner C is less than the optimum value. It is possible that the charge quantity of the cyan toner C is over the optimum value.

Case C2: The reference toner images of Level 2 to Level 6 look reddish. This case indicates that the quantity of the adhered cyan toner C is much less than that of Case 1. It is possible that the charge quantity of the cyan toner C is much over the optimum value.

Case C3: The reference toner images of Level 2 and Level 3 look blueish. This case indicates that the quantity of the adhered yellow toner Y is less than that of each of the other color toners (magenta toner M and cyan toner C). In this case, if the quantities of the other color toners (magenta toner M and cyan toner C) that are adhered are right, the quantity of the adhered yellow toner Y is less than the optimum value. It is possible that the charge quantity of the yellow toner Y is over the optimum value.

Case C4: The reference toner images of Level 2 to Level 6 look blueish. This case indicates that the quantity of the adhered yellow toner Y is much less than that of Case 3. It is possible that the charge quantity of the yellow toner Y is much over the optimum value.

Case C5: The reference toner images of Level 2 and Level 3 look greenish. This case indicates that the quantity of the adhered magenta toner M is less than that of each of the other color toners (cyan toner C and yellow toner Y). In this case, if the quantities of the other color toners (cyan toner C and yellow toner Y) that are adhered are right, the quantity of the adhered magenta toner M is less than the optimum value. It is possible that the charge quantity of the magenta toner M is over the optimum value.

Case C6: The reference toner images of Level 2 to Level 6 look greenish. This case indicates that the quantity of the adhered magenta toner M is much less than that of Case 5. It is possible that the charge quantity of the magenta toner M is much over the optimum value.

Case C7: The reference toner images of Level 2 and Level 3 look yellowish. This case indicates that the quantity of the adhered magenta toner M and the quantity of the adhered cyan toner C are not sufficient. In this case, if the quantity of the adhered yellow toner Y is right, both the quantity of the adhered magenta toner M and the quantity of the adhered cyan toner C are less than the optimum value. It is possible that both the charge quantity of the magenta toner M and the charge quantity of the cyan toner C are over the optimum value.

Case C8: The reference toner images of Level 2 to Level 6 look yellowish. This case indicates that the quantity of the adhered magenta toner M and the quantity of the adhered cyan toner C are much less than those in Case 7. It is possible that both the charge quantity of the magenta toner M and the charge quantity of the cyan toner C are much over the optimum value.

Case C9: The reference toner images of Level 2 and Level 3 look rather magenta. This case indicates that the quantity of the adhered yellow toner Y and the quantity of the adhered cyan toner C are not sufficient. In this case, if the quantity of the adhered magenta toner M is right, both the quantity of the adhered yellow toner Y and the quantity of the adhered cyan toner C are less than the optimum value. It is possible that both the charge quantity of the yellow toner Y and the charge quantity of the cyan toner C are over the optimum value.

Case C10: The reference toner images of Level 2 to Level 6 look rather magenta. This case indicates that the quantity of the adhered yellow toner Y and the quantity of the adhered cyan toner C are much less than those in Case 9. It is possible that both the charge quantity of the yellow toner M and the charge quantity of the cyan toner C are much over the optimum value.

Case C11: The reference toner images of Level 2 and Level 3 look rather cyan. This case indicates that the quantity of the adhered yellow toner Y and the quantity of the adhered magenta toner M are not sufficient. In this case, if the quantity of the adhered cyan toner M is right, both the quantity of the adhered yellow toner Y and the quantity of the adhered magenta toner M are less than the optimum value. It is possible that both the charge quantity of the yellow toner Y and the charge quantity of the magenta toner M are over the optimum value.

Case C12: The reference toner images of Level 2 to Level 6 look rather cyan. This case indicates that the quantity of the adhered yellow toner Y and the quantity of the adhered magenta toner M are much less than those in Case 11. It is possible that both the charge quantity of the yellow toner M and the charge quantity of the magenta toner M are much over the optimum value.

Case C13: The reference toner images of Level 2 to Level 6 look gray. This case indicates that the quantity of each of the adhered color toners is optimum. In this case, the charge quantity of each color toner is in the optimum level.

In the color image recording device and the color image recording method in accordance with the present invention, the color balance detecting circuit 63 checks what case (C1 to C13) the color balance of the image is equivalent to and outputs the data of the corresponding case (C1 to C13) to the secondary CPU 60. If the case is any of C1 to C12, the secondary CPU 60 outputs a Developing Bias Control signal to forcibly consume a color toner whose charge quantity is higher with reference to the secondary lookup table T2 (to be explained later).

It is assumed that the occurrence of cases C1 to C13 is related to all factors determining the quantities of adhered toners. The major factors are fluctuations of the developing performance of the developers containing color toners and fluctuations of conditions of forming reference color latent images.

Here, we can assume that the conditions of forming reference latent images of all colors are approximately identical, the major factor is considered to be the fluctuation of the developing performance of the developers. A reference toner image is rendered non-gray by the color complementary to the color of a toner whose adhered quantity is not sufficient.

If the concentrations of toners are assumed to be maintained approximately at a standard level, the reduction in the developing ability of a toner whose adhered quantity is not sufficient is caused by too much attraction between the toner and the carrier even when the developing electric field is optimum.

The primary CPU 50 which sequentially controls the image forming processes contains an Image Formation program to execute the image forming processes. When the COPY button is pressed, a START signal generates and starts the Image Formation program to execute the image forming processes.

The secondary CPU 60 stores a primary lookup table T1 that one-to-one relates image densities CD to toner concentrations Tc at an optimum quantity of toner charge, a secondary lookup table T2 that one-to-one relates data of cases C1 to C13 representing color balance status (see FIG. 5) and developing bias control data, and an Image Density Control program consisting of a Toner Concentration Judgement subprogram and a Color Balance Control program in the built-in ROM 60*a*.

The Toner Concentration Judgement program checks whether or not the toner concentration detected by each toner concentration detecting means (65BK, 65C, 65M, or 65Y) falls under a predetermined value and sends an Improper Toner Concentration signal (NG signal) when there is a color whose toner concentration is below the preset level or a Proper Toner Concentration signal (OK signal) when there is not a color whose toner concentration is right to the primary CPU 50. The primary CPU 50 contains a Toner Concentration Judgement Result register R1 which sets an NG or OK signal for each color sent from the secondary CPU 60. When an NG signal for a color is set in the register R1, the primary CPU 50 causes the toner of the color to be supplied from the corresponding toner hopper 27 to the corresponding developer 20*a* by rotating the corresponding toner supply roller 27R to keep constant the concentration of the toner in the corresponding 2-component developing agent. The Color Balance Control program detects a color unbalance if it occurs although the toner concentrations are kept approximately at predetermined levels and causes the toner of a certain color forcibly to make the color balance good. To consume toner of a certain color forcibly, this embodiment causes the developing bias circuit 64 to increase the developing bias of the color so that the charge quantity of the toner may be reduced quickly. However, the method of reducing the charge quantity of a color toner is not limited to the above. For example, the charge quantity of a toner color can be quickly reduced by changing the electrostatic process conditions (e.g., by increasing the initial charge potential) or by forcibly consuming the toner without changing the electro static conditions.

The primary CPU 50 contains two counters CT1 and CT2 to count the numbers of copies in it. The primary counter CT1 counts the number of copies which are made continuously according to detection signals sent from sensors (e.g., paper ejection sensor). The secondary counter CT2 counts the number of copies indicating timing of execution of the Color Balance Control program, that is the serial number of copies after the last control of toner charge quantity was made. To make more concrete, the Color Balance Control program is executed each time one thousand copies are made. This intermittent toner charge control is substantially effective. The toner used to form a reference toner image is removed by the cleaner of the photosensitive drum 1. This is for saving of toner because the toner is not used for normal copying.

Figure 16:
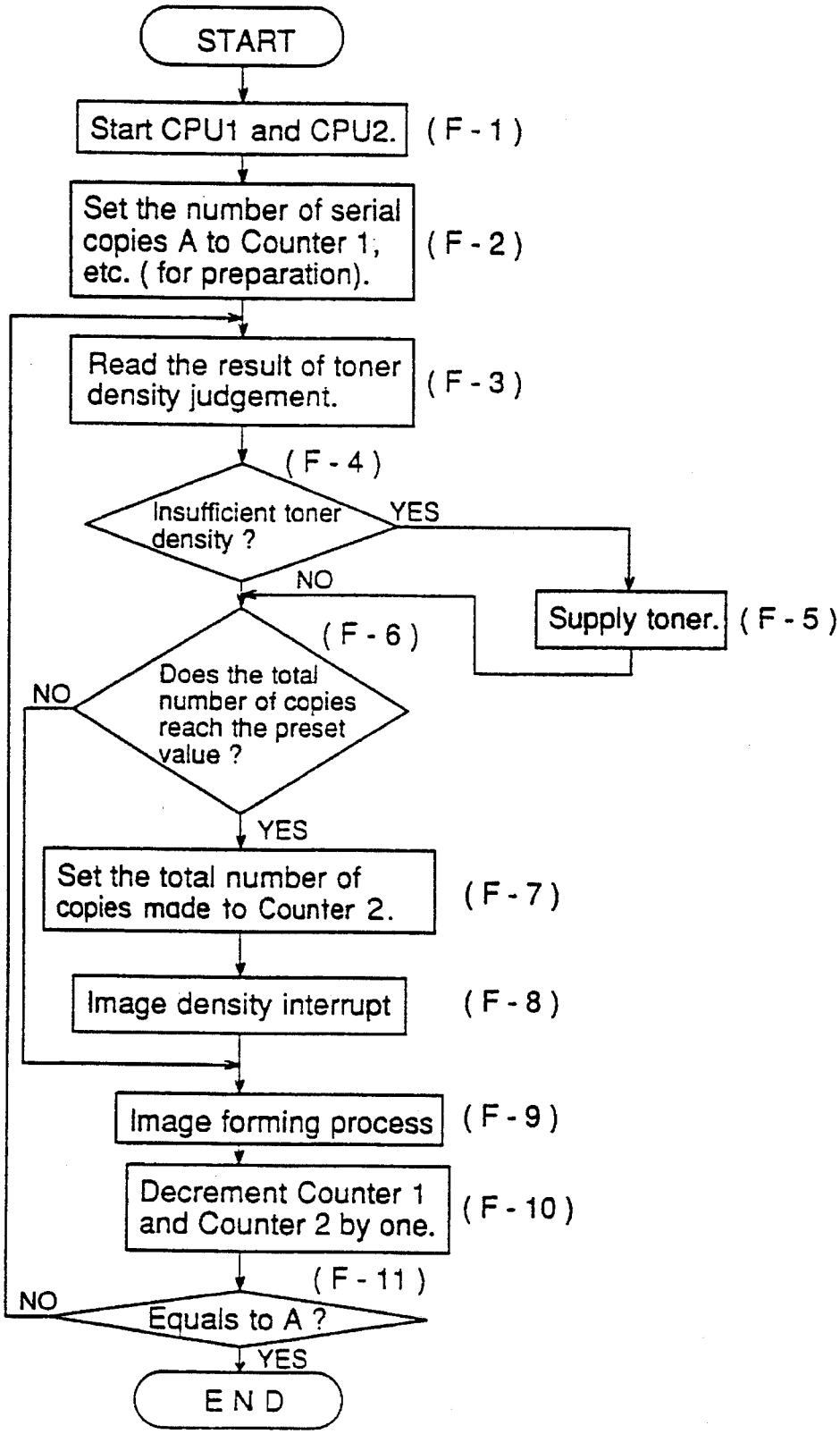
FIG. 16 shows a flow chart of the image recording operation common to embodiments.
Figure 17:
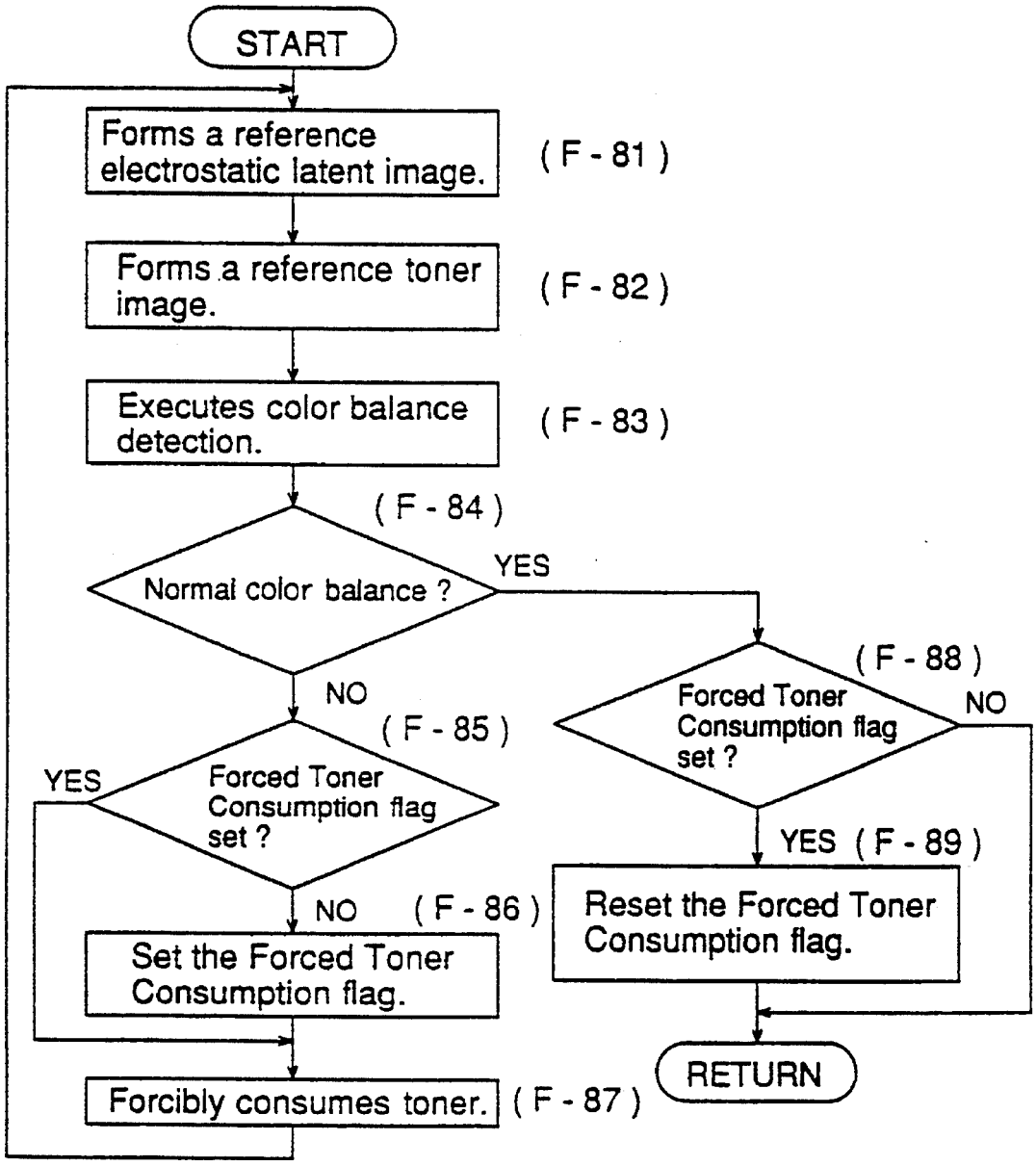
FIG. 17 shows a flow chart of the color balance control operation in the first embodiment of the present invention.

The image recording operation of the first embodiment of the present invention is explained below with reference to FIG. 16 and FIG. 17. FIG. 16 shows the main flow of the image recording operation executed by the primary CPU 50 and FIG. 17 is a flow of the color balance control operation executed by the secondary CPU 60. When the main switch (not shown in the figures) is pressed, the image recording device is powered on and both primary and secondary CPUs start to run. (See Step F-1 in FIG. 16.)

The primary CPU 50 actuates the motor driver 10 to start the main motor. The main motor rotates the primary and secondary agitating rollers 20*e* and 20*f* in each of the developers 20BK, 20C, 20M, and 20Y to agitate the 2-component developing agent in each developer. At the same time, the heater of the fixer is heated to a predetermined temperature. The primary CPU 50 engages the photosensitive drum 1 with the driving system of the main motor and rotates the drum. Further the primary CPU 50 causes the charger 41 and the discharger (not shown in the figure) to charge and discharge the photo sensitive drum 1 repeatedly to regulate the conditions for image forming processes. These operations all belong to preprocessing. Further, in preprocessing, the user-determined number of continuous copies A is set in the primary counter CT1 by the predetermined key operation. (See Step F-2 in FIG. 16.)

As already explained above, the secondary CPU 60 always checks whether or not the Toner Concentration Detection signal sent from each of the toner concentration detecting means 65BK, 65C, 65M, and 65Y is below a preset value of 7.5 wt % +/–0.5 wt % with reference to the primary lookup table T1 and sends an Improper Toner Concentration signal (NG signal) when the concentration of the toner is below the preset value (7.5 wt % +/–0.5 wt %) or a Proper Toner Concentration signal (OK signal) when the concentration of the toner is not below the preset value to the Toner Concentration Judgement Result register R1 of the primary CPU 50.

The primary CPU 50 reads a signal of each color set in the register R1 (see Step F-3 in FIG. 16) and checks whether there is a color for which an NG signal is given (see Step F-4 in FIG. 16). If there is such a color, the primary CPU causes the toner of the color to be supplied (Step F-5) and goes to Step F-6. If all colors are given an OK signal, the primary CPU directly goes to Step F-6 and checks whether the count value of the secondary counter CT2 is "0", that is whether the serial number of copies reaches the preset number of copies (1000 copies). If the serial number of copies does not reach 1000 copies, the primary CPU 50 goes to Step F-9. If the serial number of copies reaches 1000 copies, the primary CPU 50 sets the serial number of copies (1000 copies) in the secondary counter CT2 (Step F-7), generates an Image Concentration Control interrupt and outputs a Color Balance Control Command signal to the secondary CPU 60 (Step F-8).

In response to the Color Balance Control Command signal sent from the primary CPU 50, the secondary CPU 60 activates the optical scanning system 52 and causes the optical scanning system to form six reference electrostatic latent images corresponding to gray scale levels Level 1 to Level 6 on the photosensitive drum 1 in sequence. (See Step F-81 in FIG. 17.) The secondary CPU 60 drives each of the developers 20C, 20M, and 20Y to make visible all reference electrostatic latent images of Level 1 to Level 6 as color toner images (Step F-82). The six 3-color reference toner images corresponding to gray density levels Level 1 to Level 6 are formed by forming reference electrostatic latent images of Level 1 to Level 6 by writing reference latent image information on the surface of the photosensitive drum after applying a uniform charge on it and developing the latent images with cyan toner while the photosensitive drum makes the first revolution, forming reference electrostatic latent images of Level 1 to Level 6 by writing identical reference latent image information on the surface of the photosensitive drum after applying a uniform charge on it and developing the latent images with magenta toner while the photosensitive drum makes the second revolution, and forming reference electrostatic latent images of Level 1 to Level 6 by writing identical reference latent image information on the surface of the photosensitive drum after applying a uniform charge on it and developing the latent images with yellow toner while the photosensitive drum makes the third revolution.

Then the secondary CPU controls the separated color light detecting means 61, the decoder 62, and the color balance detecting circuit 63 and executes the color balance detecting process (Step F-83).

The secondary CPU 60 reads the result of color balance detection sent from the color balance detecting circuit 63 and checks whether or not the result (color balance) is Case 13 (or whether or not the color balance is good) (Step F-84). If the color balance is not Case 13 (any of Case 1 to Case 12), the secondary CPU checks whether or not the Forced Toner Consumption flag F is set (whether or not color balancing is being carried out now) (Step F-85). If the flag F is not set (or if color balancing is not being carried out now), the secondary CPU sets the flag F (Step F-86). The secondary CPU 60 reads control data corresponding to the detected case (Case 1 to Case 12) sent from the color balance detecting circuit 63 from the secondary lookup table T2 and causes the toner of the color indicated by the control data to be forcibly consumed (Step F-87). In this case, the electrostatic latent images are formed on the whole surface of the photosensitive drum 1. (Developing all over the surface) The developing bias is increased for this development. Higher developing bias can quicken consumption of toners and normalization of color balance. The developing bias for cases (C2, C4, C6, C8, C10, and C12) of using comparatively large amount of toners is made higher than that for cases (C1, C3, C5, C7, C9, and C11) of using comparatively small amount of toners. In Step F-87, the whole-surface developing is carried out several times.

After consuming toner forcibly in Step F-87, the secondary CPU returns to Step F-81 to check whether the charge quantity of the forcibly-consumed toner has reduced and the color balance has been made normal. If the Forced Toner Consumption flag F is set in Step F-85 (which means that colors have not be balanced yet although the color was consumed forcibly (because the amount of the consumed toner is very small)), the secondary CPU directly goes to Step F-87, skipping Step F-86.

When judging that the color balance is normal in Step F-84, the secondary CPU checks whether the Forced Toner Consumption flag F is set (Step 88). If the flag F is already set (which means that the color balance has become normal after the forced toner consumption), the secondary CPU resets the flag F to end the forced toner consumption (F-89), and returns. If the Forced Toner Consumption flag F has been reset (which means that the color balance remains normal and forced toner consumption is not required), the secondary CPU returns directly.

The primary CPU 50 runs the Image Formation program to execute an image forming process (Step F-9 in FIG. 16), decrements by one the count (the number of continuous copies) of the primary counter CT1 and the count (the serial number of copies) of the secondary counter CT2 (Step F-10) and checks whether the count of the primary counter CT1 is "0", that is, whether the number of continuous copies has reached the preset number of copies A (Step F-11). When the count of the primary counter CT1 is "0" and the preset number of continuous copies A has reached, the primary CPU ends the image forming process. If the preset number of continuous copies A has not reached, the primary CPU returns to Step F-3 to continue copying until the preset number of copies A comes.

A second embodiment to a fifth embodiment are explained below with reference to FIG. 18 to FIG. 21. FIG. 18 to FIG. 21 and FIG. 17 are identical in many points. So, only the differences between FIG. 18 to FIG. 21 and FIG. 17 are explained below briefly.

[Second embodiment]

Figure 18:
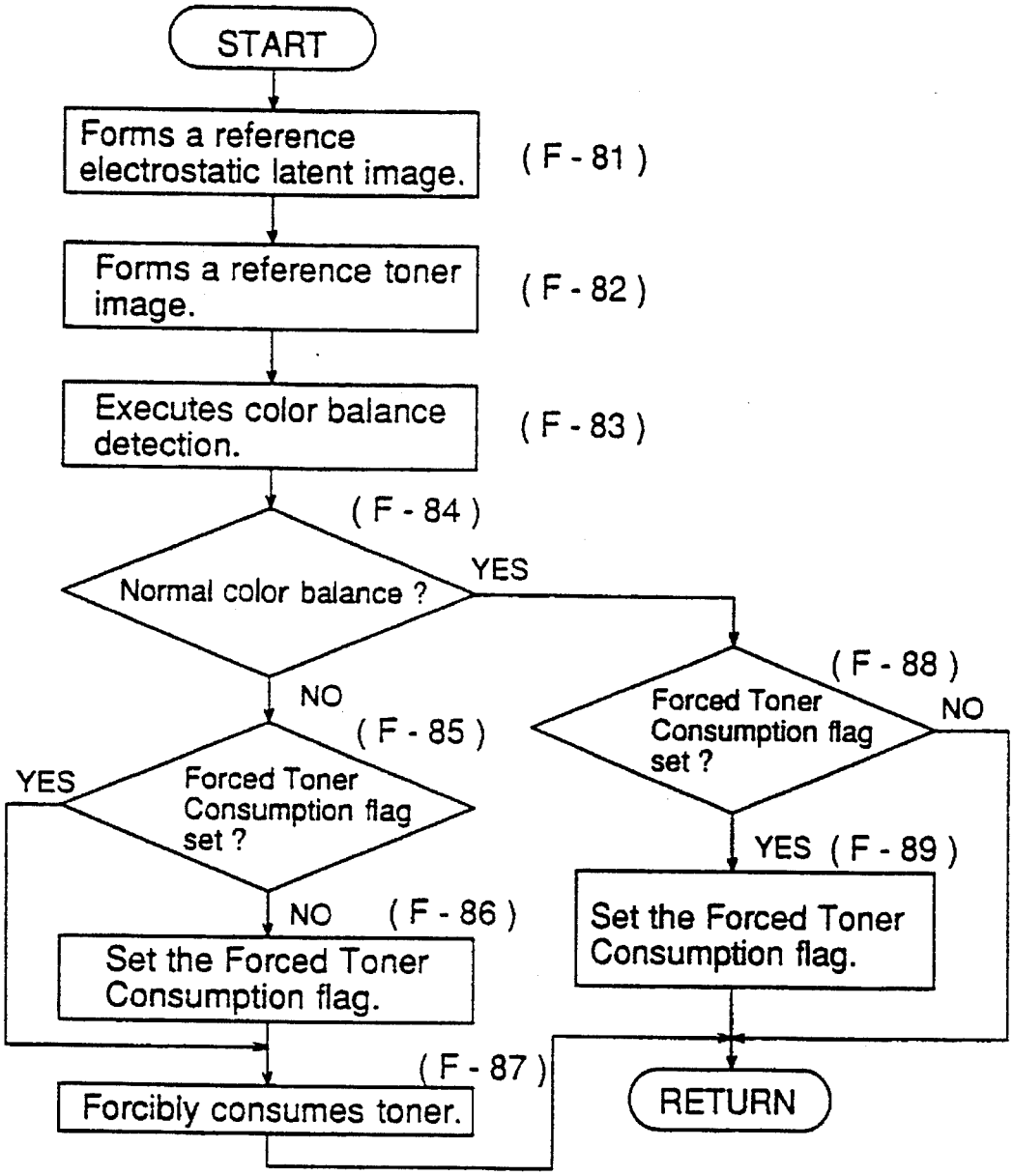
FIG. 18 shows a flow chart of the color balance control operation in the second embodiment of the present invention.

If we know in advance which color toner (having too much charge) should be consumed forcibly for recovery of developing forces, we can carry out only one forced toner consumption for color balance adjustment for each preset number of copies (e.g., 1000 copies to 5000 copies). In this case, as shown in FIG. 18, we can forcibly consume more than the known quantity of the toner in the forced toner consumption process (Step F-87), then return without going to Step F-81.

[Third embodiment]

Figure 19:
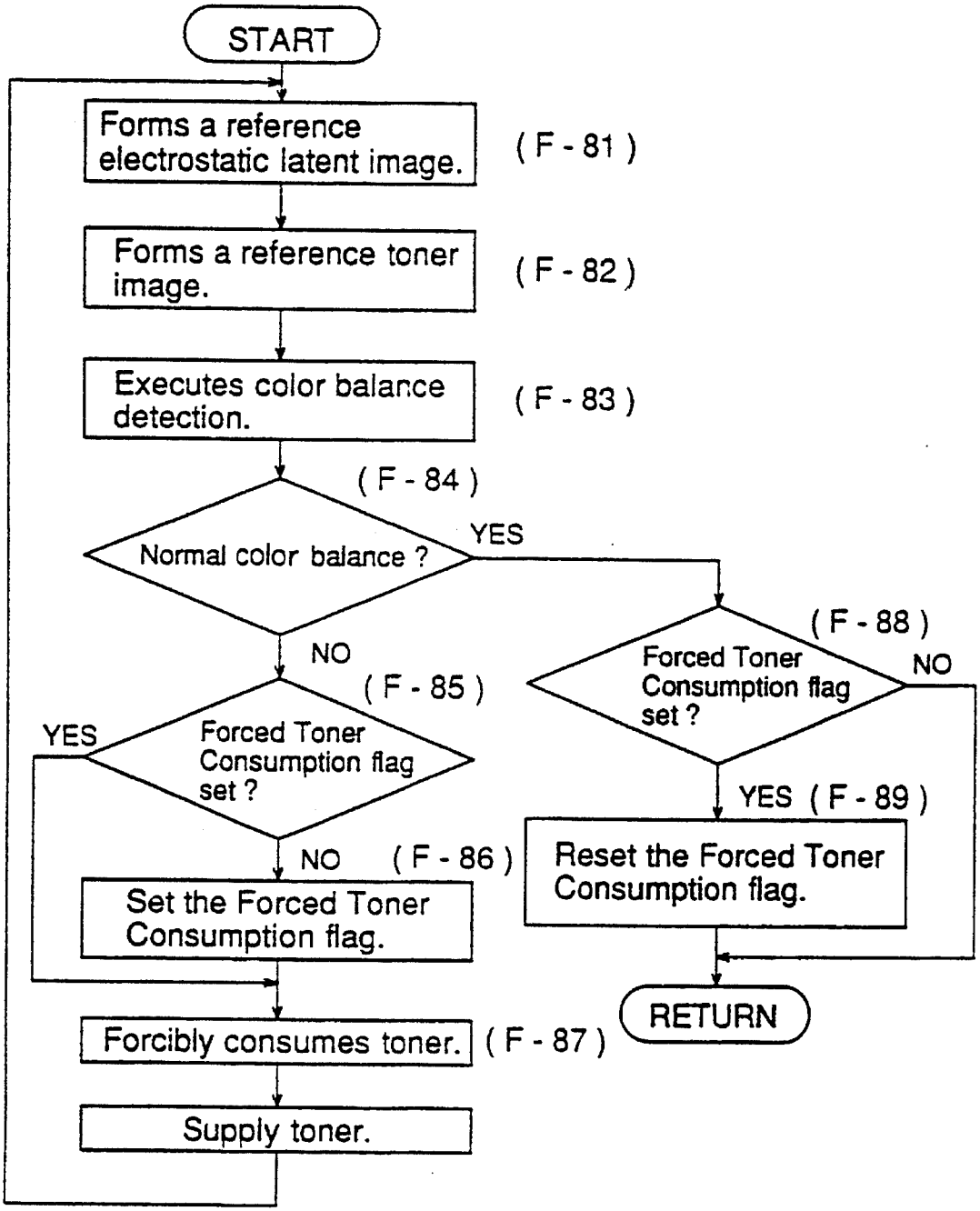
FIG. 19 shows a flow chart of the color balance control operation in the third embodiment of the present invention.

If we know in advance which color toner (having too much charge) should be consumed forcibly for recovery of developing forces, we can carry out only one forced toner consumption for color balance adjustment for each preset number of copies (e.g., 1000 copies to 5000 copies), then forcibly supply fresh toner of the color to the corresponding developer for efficient freshup of the deteriorated developing agent (for suppression of increase of toner charge). In this case, as shown in FIG. 19, we can forcibly consume more than the known quantity of the toner in the forced toner consumption process (Step F-87), supply toner of the color, then return without going to Step F-81.

[Fourth embodiment]

If the color balance cannot be normalized after a preset number of forced toner consumptions (e.g., three times) are carried out for color balancing, a message or notice to replace developing agents or developers can be given assuming that the color balance will not be normalized any more by further forced toner consumption.

Figure 20:
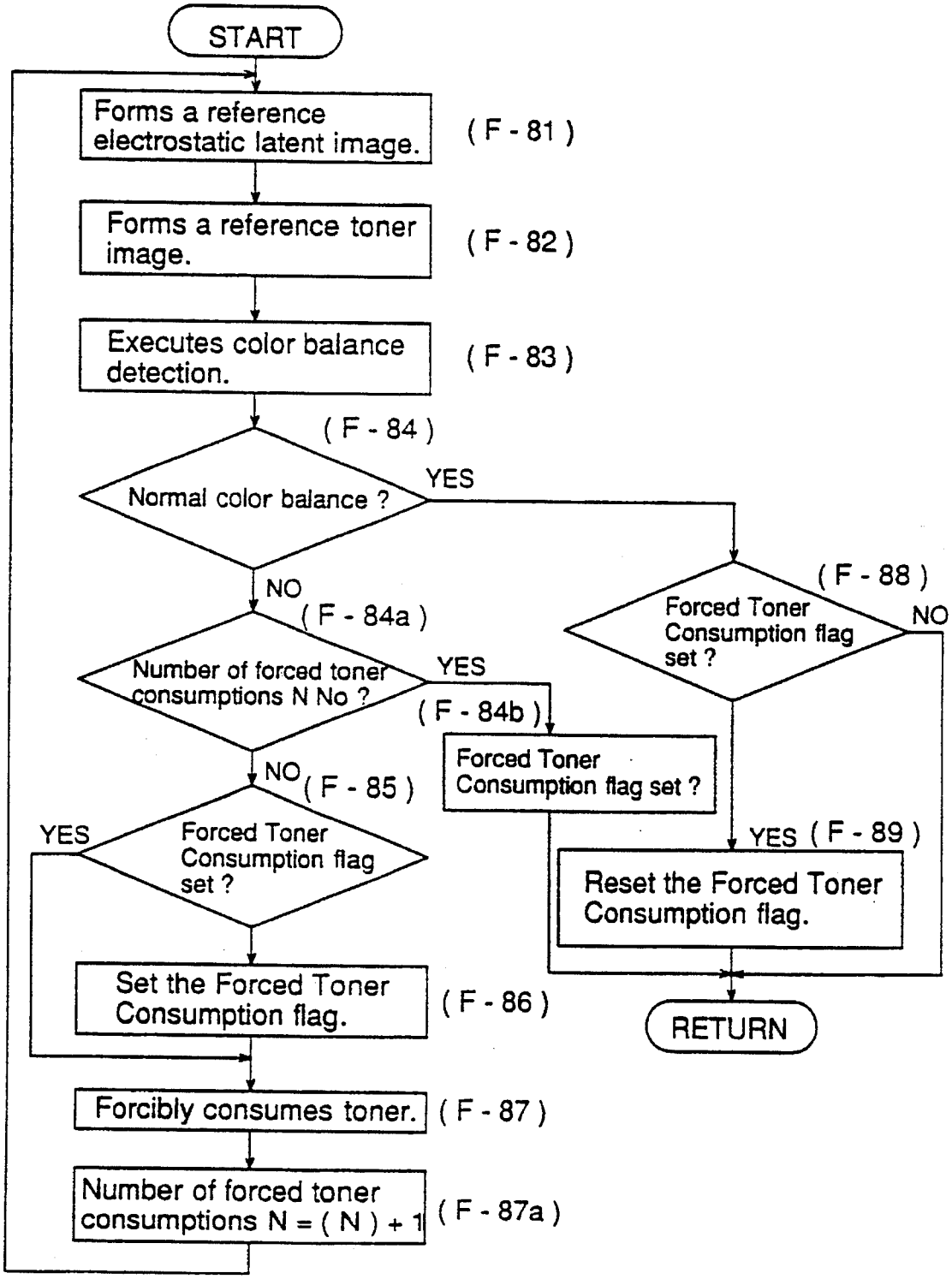
FIG. 20 shows a flow chart of the color balance control operation in the fourth embodiment of the present invention.

FIG. 20 illustrates the above operation. When color unbalance is detected in Step F-84, the CPU checks whether the number of the forced toner consumptions (N) that have been made is equal to a preset number of forced toner consumptions (No) (Step F-8*a*). If the number N is under the number No, the CPU goes to Step F-85. After passing through Step F-85, Step F-86, and a forced toner consumption in Step F-87, the CPU increments the number of forced toner consumptions (N) by one (Step F-87) and returns to Step F-81. If the number N equals to the number No in Step F-84*a*, a message or notice to replace developing agents or developers can be given assuming that the color balance will not be normalized any more by further forced toner consumption.

[Fifth embodiment]

If the color balance cannot be normalized after a preset number of forced toner consumptions (e.g., three times) are carried out for color balancing, the developing conditions can be changed.

Figure 21:
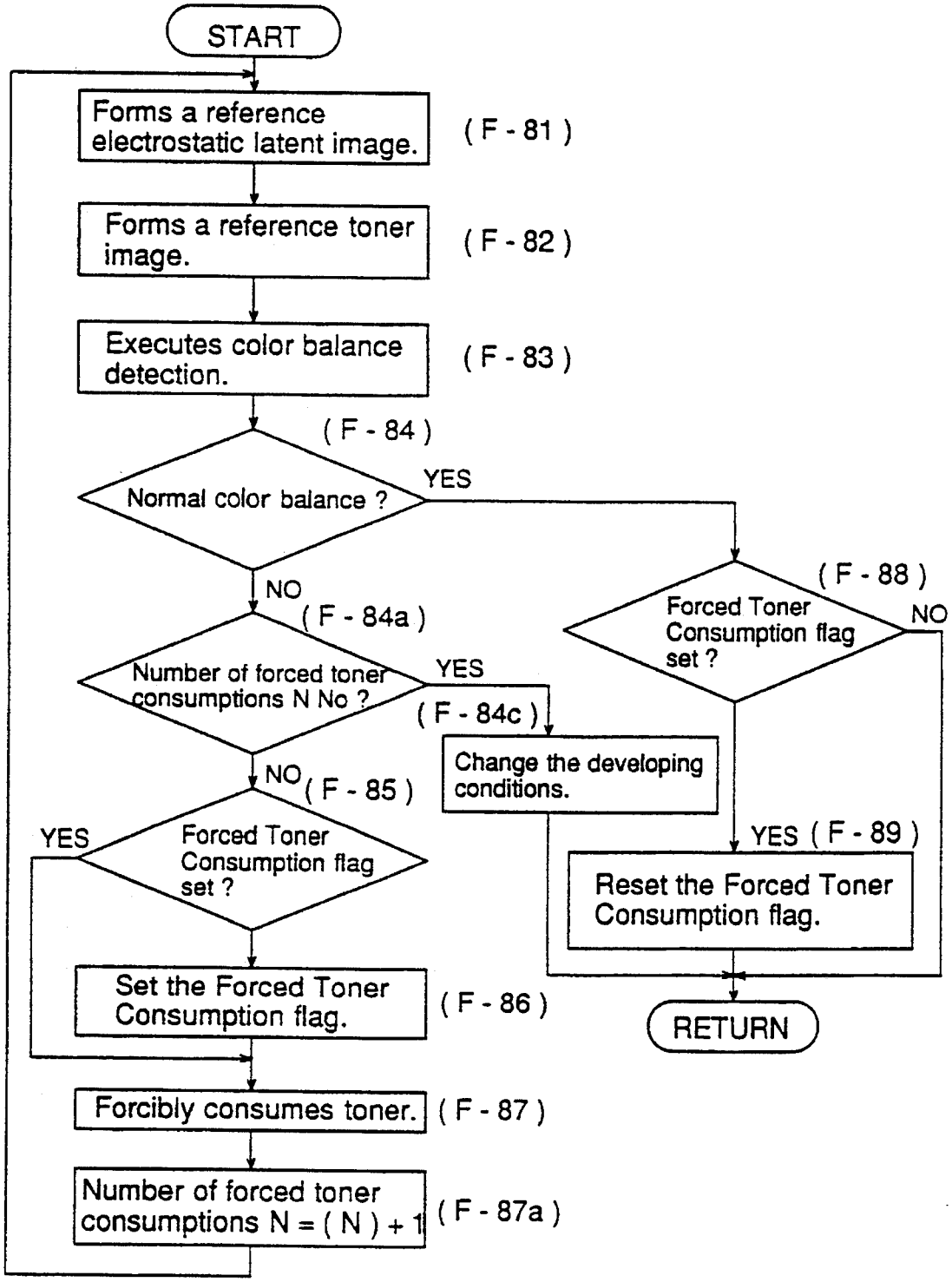
FIG. 21 shows a flow chart of the color balance control operation in the fifth embodiment of the present invention.

FIG. 21 illustrates the above operation. When color unbalance is detected in Step F-84, the CPU checks whether the number of the forced toner consumptions (N) that have been made is equal to a preset number of forced toner consumptions (No) (Step F-8*a*). If the number N is under the number No, the CPU goes to Step F-85. After passing through Step F-85, Step F-86, and a forced toner consumption in Step F-87, the CPU increments the number of forced toner consumptions (N) by one (Step F-87) and returns to Step F-81. If the number N equals to the number No in Step F-84*a*, the CPU changes the developing conditions (Step F-84*c*) and returns. The changes of the developing conditions can be one or more of a change of the developing bias, a change of the charge potential on the photosensitive unit, a change of the intensity of exposure light (or a change of pulse width in the pulse-width modulation method), a change of the developing bias, and a change of the rotational speed (rpm) of the developing sleeve. It is a matter of course that the developing conditions should be changed to improve the developing characteristics.

As explained above, according to the image recording method and device of the present invention, color images of optimum image densities and good color balances can be reproduced by forcibly consuming toner(s) of color(s) whose image density reduces even when the image density of respective colors reduces although the concentrations of toners are kept approximately at predetermined values.

What is claimed is:

1. A method of forming yellow, magenta and cyan color toner images on a photoreceptor, comprising the steps of:

charging a photoreceptor to a charged electric potential;

exposing the photoreceptor so as to form a reference latent image for each of three colors with an exposure light having a reference image density;

developing the reference latent images respectively with yellow, magenta and cyan color toners so as to form a superimposed three color toner image;

separating a reflected light obtained from the superimposed three color toner image formed on the photoreceptor into a plurality of separate colors;

detecting a color balance between the superimposed three color toner images from the separated colors; and consuming at least one color toner of the yellow, magenta and cyan color toners in accordance with a detection result of the color balance so that a new color balance of the superimposed three color toner images will have a desired color balance.

2. The method of claim 1, further comprising the step of supplying fresh color toner after the consuming step.

3. The method of claim 1, further comprising the steps of:

counting each use of said yellow, magenta and cyan color toners; and replenishing one of said color toners whenever a predetermined number of uses of one of said color toners is counted.

4. The method of claim 1, further comprising changing a process condition of one of the charging, exposing and developing steps when an execution time of the counting step counts a predetermined number of uses of said one of said color toners in a predetermined period of time.

5. The method of claim 1, wherein the consuming step comprises providing one of the yellow, magenta and cyan color toners so that said one color toner is adhered onto the photoreceptor.

6. A method of forming yellow, magenta and cyan color toner images on a recording material, comprising the steps of:

charging a photoreceptor to a charged electric potential;

exposing the photoreceptor so as to form a reference latent image for each of three colors with an exposure light having a reference image density;

developing the reference latent images respectively with yellow, magenta and cyan color toners so as to form a superimposed three color toner image;

transferring the superimposed three color toner image onto the recording material;

separating a reflected light obtained from the superimposed three color toner image formed on the recording material into separate colors;

detecting a color balance between the superimposed three color toner images from the separated colors; and consuming at least one color toner of the yellow, magenta and cyan color toners in accordance with a detection result of the color balance so that a new color balance of the superimposed three color toner images will have a desired color balance.

7. The method of claim 6, further comprising the step of supplying fresh color toner after the consuming step.

8. The method of claim 6, further comprising the steps of:

counting each use of said yellow, magenta and cyan color toners; and replenishing one of said color toners whenever a predetermined number of uses of one of said color toners is counted.

9. The method of claim 6, further comprising changing a process condition of one of the charging, exposing and developing steps when an execution time-of the counting step counts a predetermined number of uses of said one of said color toners in a predetermined period of time.

10. The method of claim 6, wherein the consuming step comprises providing one of the yellow, magenta and cyan color toners so that said one color toner is adhered onto the recording material photoreceptor.

11. An apparatus for forming at least yellow, magenta and cyan color toner images on a photoreceptor, comprising:

means for charging a photoreceptor to a charged electric potential;

means for exposing the photoreceptor with an image light having a reference image density on the photoreceptor so as to form a respective reference latent image for each of a yellow, a magenta and a cyan color;

a plurality of developing means for developing each of the yellow, magenta and cyan reference latent images with a corresponding one of a yellow, a magenta and a cyan color toner so as to form a superimposed three color toner image on the photoreceptor;

means for separating a light reflected from the superimposed three color toner image into red, green and blue color components, and for detecting said red, green and blue color components; and a color balance control means for controlling a consumption of at least one color toner of the yellow, magenta and cyan color toners in accordance with a detection result of said red, green and blue color components so that a color balance between the colors of the superimposed three color toner image will be adjusted to have a desired color balance.

12. The apparatus of claim 11, further comprising:

a toner concentration controller for controlling a toner concentration of each of the plurality of developing means; and a developing potential gap controller for controlling a developing gap potential of each of the plurality of developing means.

13. The apparatus of claim 12, wherein the toner concentration controller detects a color toner concentration of the toner of each of the plurality of developing means and supplies color toner to a corresponding one of the plurality of developing means so as to keep the color toner concentration of said corresponding one of said toners within a desired toner concentration range.

14. The apparatus of claim 13, wherein, when the toner concentration of each of the plurality of developing means is within the desired toner concentration range and when the detection result of one of the red, green and blue color components is not in a desired image density range, then the developing potential gap controller changes the developing potential gap used for the developer of a corresponding color.

15. The apparatus of claim 14, wherein, the plurality of developing means are of a normal development type, and the developing potential gap of each developing means is controlled by the developing potential gap controller to have a potential value which is a difference between a charged electric potential on the photoreceptor and a developing bias potential applied between the photoreceptor and the developing means of the corresponding color.

16. The apparatus of claim 14, wherein, the plurality of developing means are of a reversal development type, and the developing potential gap of each developing means is controlled by the developing potential gap controller to have a potential value which is a difference between the developing bias potential and an electric potential of a corresponding one of the latent images exposed on the photoreceptor.

17. The apparatus of claim 14, wherein, when the detection result of one of the red, green and blue color components is lower than the desired image density range, then the developing potential gap controller increases the developing gap potential for the developing means for the corresponding color.

18. The apparatus of claim 12, wherein a plurality of color toner images are superimposed on the photoreceptor, and the developing gap for a color toner image on an upper layer of the superposed image is larger than the developing gap for another color toner image on a lower layer of the superimposed image.

19. A method of forming yellow, magenta and cyan color toner images, comprising the steps of:

charging a photoreceptor to a charged electric potential;

exposing the photoreceptor so as to form a reference latent image for each of a yellow, a magenta and a cyan color with an exposure light having a reference image density;

developing the reference latent images respectively with yellow, magenta and cyan color toners so as to form a superimposed three color toner image;

separating a reflected light obtained from the superimposed three color toner image into separated colors;

detecting a color balance between the three color toner images forming the superimposed three color toner image from the separated colors; and consuming at least one color toner of the yellow, magenta and cyan color toners in accordance with a detection result of the color balance so that a new color balance of the superimposed three color toner image will have a desired color balance.

20. A method of forming yellow, magenta and cyan color toner images, comprising the steps of:

charging a photoreceptor to a charged electric potential;

exposing the photoreceptor so as to form a reference latent image for each of a yellow, a magenta and a cyan color with an exposure light having a reference image density;

developing the reference latent images with one of a yellow, a magenta and a cyan color toner;

repeating the charging, exposing, and developing steps so as to form a superimposed three color toner image;

separating a reflected light obtained from the superimposed three color toner image into separated colors;

detecting a color balance between the superimposed three color toner images forming the superimposed three color toner image from the separated colors; and consuming at least one color toner of the yellow, magenta and cyan color toners in accordance with a detection result of the color balance so that a new color balance of the superimposed three color toner image will have a desired color balance.

* * * * *

UNITED STATES PATENT AND TRADEMARK OFFICE

CERTIFICATE OF CORRECTION

PATENT NO. : 5,486,901

DATED : January 23, 1996

INVENTOR(S) : Masakazu FUKUCHI et al.

It is certified that error appears in the above-indentified patent and that said Letters Patent is hereby corrected as shown below:

Title Page, Item [54] and col. 1, line 1, in Title, delete "COLOR".

Signed and Sealed this

Twenty-second Day of April, 1997

Bruce Lehman

*Attest:*

BRUCE LEHMAN

*Commissioner of Patents and Trademarks*

*Attesting Officer*